US005645521A

United States Patent [19]

Hepburn et al.

[11] Patent Number: 5,645,521

[45] Date of Patent: Jul. 8, 1997

[54] SHOULDER PHYSICAL THERAPY DEVICE

[75] Inventors: George R. Hepburn, Severna Park; Russell Vedeloff, Greensboro, both of Md.

[73] Assignee: Dynasplint Systems, Inc., Severna Park, Md.

[21] Appl. No.: 587,961

[22] Filed: Jan. 17, 1996

Related U.S. Application Data

[63] Continuation-in-part of Ser. No. 493,403, Jun. 22, 1995, Pat. No. 5,558,624.

[51] Int. Cl.[6] ..... A61F 5/04

[52] U.S. Cl. ..... 601/33; 482/130; 482/136

[58] Field of Search ..... 482/121, 127–130, 482/133, 135–136, 905, 908; 601/5, 23–24, 33–34, 85, 89, 97, 112

[56] References Cited

U.S. PATENT DOCUMENTS

| | | | |
|---|---|---|---|
| 3,029,076 | 4/1962 | Andersen . | |
| 3,042,023 | 7/1962 | Yates | 601/33 |
| 3,683,897 | 8/1972 | Shield et al. . | |
| 4,108,429 | 8/1978 | Minichiello | 482/127 X |
| 4,214,577 | 7/1980 | Hoy . | |
| 4,239,212 | 12/1980 | Hickey | 482/128 X |
| 4,546,971 | 10/1985 | Raasoch | 482/100 |
| 4,577,623 | 3/1986 | Pecheux . | |
| 4,651,719 | 3/1987 | Funk et al. . | |
| 4,669,451 | 6/1987 | Blauth et al. . | |
| 4,822,027 | 4/1989 | Kascak | 482/130 X |
| 4,865,317 | 9/1989 | Hickey | 482/128 X |
| 4,944,508 | 7/1990 | Collins | 482/121 X |
| 5,080,350 | 1/1992 | Schofield et al. | 482/133 X |
| 5,179,939 | 1/1993 | Donovan et al. . | |
| 5,335,649 | 8/1994 | Randall et al. . | |
| 5,417,643 | 5/1995 | Taylor . | |

FOREIGN PATENT DOCUMENTS

| | | | |
|---|---|---|---|
| 308886 | 11/1918 | Germany . | |
| 3726825 | 2/1989 | Germany | 482/133 |
| 4006518 | 3/1994 | WIPO | 482/121 |

*Primary Examiner*—Richard J. Apley
*Assistant Examiner*—David R. Risley
*Attorney, Agent, or Firm*—Leonard Bloom

[57] ABSTRACT

An articulated physical therapy device used in the therapy of a frozen shoulder is provided with tensioning means. In the preferred embodiment of the device there is a reciprocating strut employing rods and plates enclosed in a tube. The preferred embodiment can also be provided with a cam-operated detent for easy adjustment of the length of the forearm strut. Means are provided for easy removal of the reciprocating upper arm unit. A detent and keeper are provided for convenient changing of the reciprocating unit from the left side protractor retainer to the right side protractor retainer.

19 Claims, 28 Drawing Sheets

SHOULDER PHYSICAL THERAPY DEVICE

CROSS REFERENCE TO RELATED APPLICATION

This application is a continuation-in-part of our application Ser. No. 08/493,403 filed on Jun. 22, 1995 which issued as U.S. Pat. No. 5,558,624.

STATEMENT REGARDING FEDERALLY SPONSORED RESEARCH OR DEVELOPMENT (Not Applicable.)

REFERENCE TO A MICROFICHE APPENDIX SPECIFYING THE TOTAL NUMBER OF MICROFICHE AND TOTAL NUMBER OF FRAMES (Not Applicable.)

BACKGROUND OF THE INVENTION

This invention relates to physical therapy devices, and more specifically, to adjustable devices intended to treat shoulder joint contracture or "frozen shoulder".

Many physiological conditions can bring on a condition known in laymen's terms as "frozen-shoulder", known technically in medical terms as Adhesive Capsulitis. This condition causes a restricted range of motion of the shoulder due to the contracture of tendons, muscles, ligaments and the capsule surrounding the joint. The condition can be brought about by a fall, the tearing of the rotator cuff, surgical repair of the rotator cuff, fracture of the Humerus or bursitis, etc. The condition is brought about because the tendons and muscles surrounding the joint capsule and rotator cuff shrink down and tighten up. This condition is most prevalent in the 35–75 year age bracket.

The shoulder is formed where the clavicle, scapula and humerus join. The joint formed is a ball-and-socket type articulation between the proximal humerus and the glenoid cavity of the scapula. The socket is shallow, and the joint capsule is loose-fitting. As a result of this construction, the joint permits a wide range of motion but is subject to poor stability and strength.

The shoulder is capable of three general types of motion: abduction and adduction, flexion and extension; and rotation. Abduction and adduction are movements of the arm away from and toward the median axis, or long axis, in the median plane of the body. The median plane of the body is defined by the front or back of the body in a straight position. Abduction is movement away from the median axis, such as raising an arm laterally or sideways. Adduction is the opposite movement, i.e., movement toward the median plane of the body. Rotation is turning the arm about its long axis as if on a pivot. External rotation is rotation away from the median axis of the body and internal rotation is rotation toward the median axis of the body.

Prior Art U.S. Patents

In U.S. Pat. No. 4,669,451, Bleuth et al teach a device for exercising the shoulder joint. The device is secured to the body and is able to exercise the shoulder in a horizontal pivot axis, as well as a vertical pivot axis; which two axes intersect each other in the afflicted shoulder joint. An additional motion generating and transmitting unit can be provided to pivot two articulated connected portions of the arm support in the region of the elbow.

Funk et al in U.S. Pat. No. 4,651,719 describes a lightweight portable device to impart continuous passive motion to a user's shoulder. The device is fashioned to produce abduction, adduction, as well as simultaneous rotation. The device produces continuous passive motion to the shoulder. The device passively produces abduction and adduction of the arm about the shoulder and optionally causes simultaneous rotation of the arm as well. The device is actuated by a mechanical drive mechanism.

A passive shoulder exerciser to move the patient's arm back and forth through an arc to provide flexion and abduction of the shoulder is described by Donovan et al in U.S. Pat. No. 5,179,939. The device is a motor driven passive device.

Randall et al in U.S. Pat. No. 5,335,649 describes a mechanized machine employed in various stretching exercises. Different parts of the body can be exercised.

None of the prior art patents teach or suggest an articulated frozen-shoulder physical therapy device which is multi-axial, with a choice of preset tensioning points.

OBJECTS OF THE INVENTION

With all of this in mind, it is an object of this invention to produce a physical therapy device facilitating the treatment and cure of frozen-shoulder or shoulder contracture.

A most important object of this invention is to produce a device which will shorten the recovery time for the patient with shoulder contracture.

A further object of this invention is to produce a device which is easy for the physical therapist, as well as the patient to use.

A main object of this invention is to create a physical therapy device with an improved reciprocating telescoping upper arm strut.

An important object of this invention is to provide physical therapy device provided with adjustments making it easy to accommodate use to the individual user.

SUMMARY OF THE INVENTION

The DynaSplint™ physical therapy device or the Shoulder LPS™ (Low-Load, Prolonged-Duration Stress) System of this invention is a device designed primarily to treat "Frozen Shoulder". This condition is not necessarily painful, but does involve the inability to elevate the arm. The condition in the past has been treated with physical therapy; or by surgery under general anesthesia, with the shoulder being forcefully manipulated and the frozen state relieved.

The DynaSplint™ frozen shoulder physical therapy device is designed to eliminate surgery and improve patient recovery time, thereby assuring quick return to a normal routine. Success of the treatment will be known when the patient is able to achieve a position of 135 degrees of abduction, 90 degrees of external rotation and 180 of flexion. Improved recovery time will bring about reduced medical expenses and will thereby be cost-saving to the patient and/or the patient's insurer.

The method of therapy for the release of frozen shoulder envisioned by this invention is the stretching and stressing of the joint using the frozen shoulder physical therapy device, supplemented with an ongoing physical therapy program. The device will be used only about a half hour per session, with the object of the therapy being to get release of the contracture.

The Dynasplint™ frozen shoulder physical therapy device is a departure from prior Dynasplint™ braces known in the art. The prior braces were made of a single hinged joint. They were made to accommodate the wrist, elbow, knee or ankle, etc. which are primarily simple hinged joints. On the other hand the shoulder moves in all planes and therefore the new device has to have more adjustments. The adjustments relate to ranges; and being able to adjust and accommodate the patient for flexion, extension, as well as internal and external rotation; abduction and adduction. The device of this invention combines several motions and is a multiaxial rotational device. Flexion and abduction are combined into elevation. Elevation and external rotation are set with the protractor device at a specific angle. Once the protractor is set, the shoulder when put in motion will find the path of least resistance. After resting at that point, the device allows the shoulder to glide back at just the right point.

The inventive frozen shoulder therapy device, unlike passive shoulder therapy devices of the prior art, depends on motion from the patient. In other words the patient moves the device; the device does not move the patient since the inventive device is not motor-driven. The Dynasplint™ physical therapy device is spring loaded and in use will tend to force the patient back, and put the shoulder under pressure, but when relief from stress is desired the patient can release the tension and reduce discomfort simply by reverting to the unstressed state. This is a significant feature of the inventive device.

The new physical therapy unit is similar to the existing line of DynaSplint™ therapy devices in that there are multiple adjustments in the amount of stress or tension in the unit. There are two movements in which stress or tension are applied. These are elevation and external rotation. There is one spring which exerts pressure when the arm is elevated, there is a second spring which exerts pressure when the arm is externally rotated, and the tension can be adjusted on each.

The articulated frozen shoulder physical therapy device of the invention can be characterized as having an 1. adjustable forearm strut,
2. a reciprocating, telescoping upper arm strut,
3. a retaining means,
4. an adjustable protractor, and
5. a base.

The adjustable forearm strut is hingedly attached to the telescoping upper arm strut which in turn is hingedly attached to a protractor retaining means secured to the base.

The articulated portions of the device accommodate the way the shoulder moves; they compliment arm movement. In order to further accommodate arm movement the therapy device employs a reciprocating telescoping upper arm strut. This telescoping strut is finely engineered with bearings and rods and telescopes freely. This reciprocating telescopic arrangement is a key factor for obtaining functionality for the frozen shoulder physical therapy device.

The new device accommodates multiaxial rotation of the shoulder. The term multiaxial rotation means that the frozen-shoulder therapy device allows for the multiaxial movement of the shoulder joint while maintaining the position of the device attached to the patient. For example, the multiaxial movement will accommodate vertical abduction and vertical adduction; horizontal abduction and horizontal adduction; as well as, external rotation and internal rotation.

In its broadest aspect this invention is directed to an articulated frozen shoulder physical therapy device for extending the range of motion of a frozen shoulder. The device is an articulated device which allows for the active multiaxial physical therapy of a frozen shoulder. The articulated device is provided with a forearm strut and an upper arm strut, as well as one or more tensioning means to place stress on the shoulder during active multiaxial exercise. As a result of this physical therapy the mobility of the shoulder is hastened. The shoulder returns to normal mobility in the directions of flexion, extension, abduction, adduction, horizontal abduction, horizontal adduction, external rotation and internal rotation.

The articulated frozen shoulder physical therapy device has a tensioning means to place stress on the shoulder. The tensioning means are positioned at the elbow hinge and/or shoulder hinge. Further, the tensioning means is provided with a mechanism for quantifiably adjusting the amount of tension.

In addition, the shoulder physical therapy device has an upper arm strut which is a reciprocating telescoping strut allowing for lengthening or shortening of the telescoping strut during active multiaxial physical therapy of a frozen shoulder.

Further, the device has a forearm strut provided with a means to adjust the length, as well as a means to secure the arm to the strut.

There is a base having mounted thereon a protractor and fixedly attached to the protractor a securing means or retainer for attaching said articulated frozen shoulder physical therapy device.

The invention is more specifically directed to an articulated frozen shoulder physical therapy device releasing a frozen shoulder. The device allows for multiaxial physical therapy of the frozen shoulder in the directions of flexion, extension, abduction, adduction, horizontal abduction, horizontal adduction, external rotation and internal rotation. The main components of the device are:

an adjustable forearm strut,
a reciprocating, telescoping upper arm strut,
an adjustable protractor retaining means, and a base.

The forearm strut has attached thereto a means for retaining the forearm. The telescoping upper arm strut is tensionally hinged to said adjustable forearm strut. The telescoping upper arm strut is pivotally tensionally attached to an adjustable protractor retaining means which in turn is attached to said adjustable protractor attached to the base. When a patient is fitted into the device with the tensioning means set, the patient can engage in multiaxial physical therapy for a frozen shoulder. The articulated frozen shoulder physical therapy device is provided with an adjustable spring which produces the tension on the tensionally hinged and pivotally tensionally attached components of the device. The spring is provided with a mechanism for quantifiably adjusting the amount of tension. The forearm strut is provided with a means to adjust the length of the forearm strut and has a means for securing the arm to the forearm strut.

There are several improved features encompassed by a preferred embodiment of the frozen shoulder physical therapy device of this invention.

1. In the preferred embodiment, there has been provided a vastly improved reciprocating telescopic upper arm strut to allow for flexion and extension at the shoulder. The improved reciprocating telescoping strut has been provided with a series of improvements over the prior reciprocating telescoping strut by supplying bearings, scope plates and rods which provide the device with reduced friction, as well as torsion resistance. Accordingly, the strut will not bend, bind or twist to impede normal use.
2. The preferred embodiment incorporates a length adjusting mechanism for the upper arm strut, as well as a lower arm strut-length adjusting mechanism.
3. A protractor guide has been added to stabilize and guide the protractor as angle adjustments are made.

4. There is an improved detent and keeper for ease of moving the therapy device from the left side protractor retainer to the right side protractor retainer.

In its broadest aspect the preferred embodiment of this invention encompasses a physical therapy device provided with a reciprocating telescoping assembly wherein a reciprocating telescoping mechanism comprises an assembly having a first end and a second end and attached there between is a series of rods capable of reciprocating through a series of plates such that during the stretching and extending phase of physical therapy the reciprocating telescoping device will allow for the reciprocating motion required. More specifically, the device is provided with converse sets of rods capable of reciprocating through converse sets of plates. The second series of rods and plates is serially joined to said first series of rods and plates. The rods and plates are housed in a tube with the plates being set vertically to the horizontal axis of the tube and the rods being set in a parallel relationship to the tube.

The preferred embodiment physical therapy device of this invention is an articulated device which allows for active multiaxial physical therapy. Most importantly, the physical therapy device has tensioning means incorporated to provide tension during physical therapy.

DESCRIPTION

Figure 1:
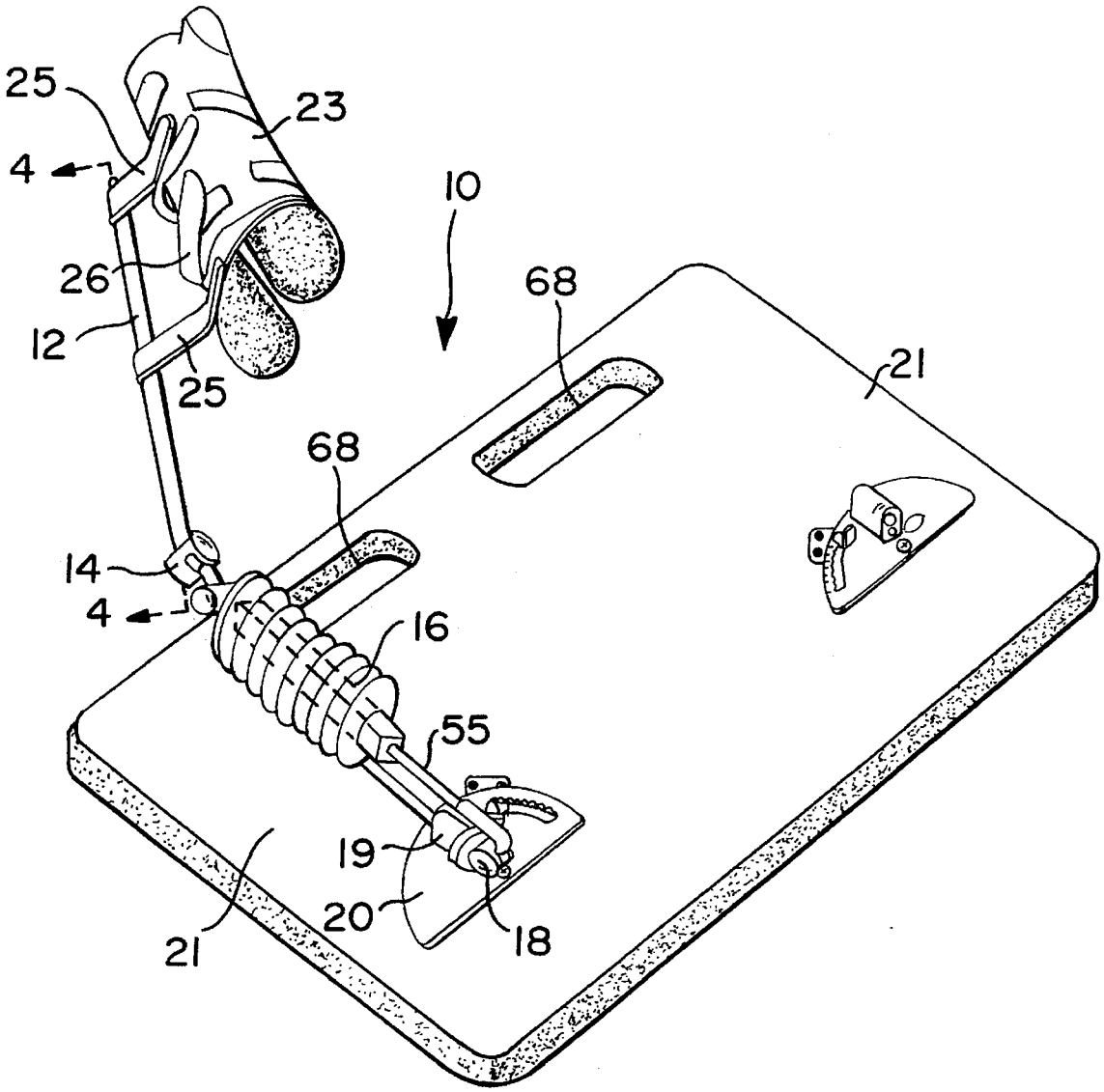
FIG. 1 is a perspective view of the frozen-shoulder physical therapy device of this invention.

Referring to FIG. 1, the articulated frozen-shoulder physical therapy device 10 of this invention is shown in the extended position. The device 10 is provided with an articulated forearm strut 12 hingedly attached as at 14, to a reciprocating telescoping upper arm strut 16. The opposite end of the telescoping upper arm strut 16 is pivotally hinged, as at 18, to a retainer or retaining means 19 mounted on a protractor gauge 20. The protractor gauge 20 in turn is fixedly attached to the back support base 21 of the frozen shoulder physical therapy device 10.

Figure 2:
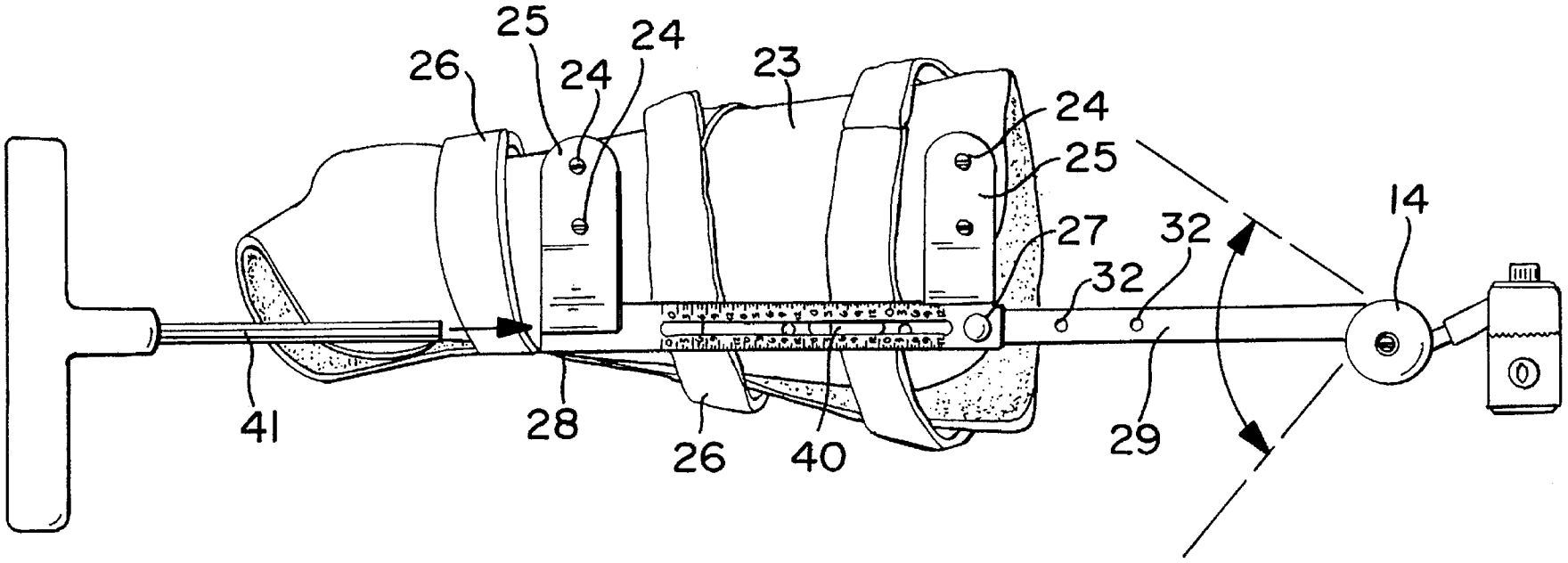
FIG. 2 is a view illustrating the forearm strut assembly.
Figure 3:
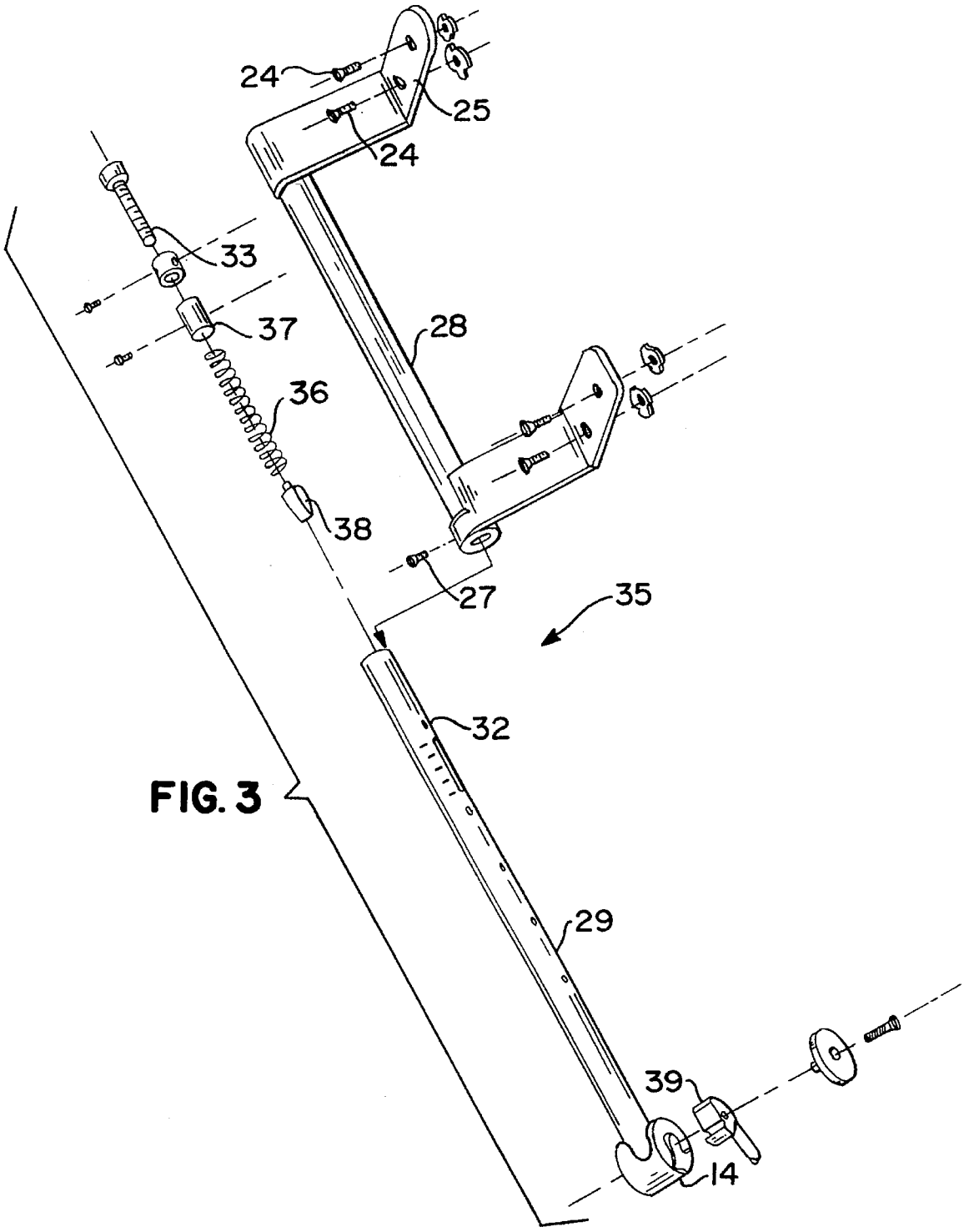
FIG. 3 is an exploded perspective view illustrating the parts of the forearm strut assembly.

With reference to FIGS. 2 and 3, an arm cuff 23 is fixedly attached by screws 24 to brackets 25 carried by the forearm strut 12. In the use of the frozen shoulder physical therapy device 10 the patient inserts his forearm into the cuff 23 and tightens the cuff 23 around the fore arm with "Velcro" strips 26. Forearm strut 12 has an outer portion 28 and an inner portion 29. The outer portion 28 slides over the inner portion 29, and the length of the forearm strut 12 can be adjusted to accommodate the length of the patient's forearm. Holes 31, 32 aligned in the outer portion 28 of the forearm strut 12 and the inner portion 29 of the forearm strut 12 respectively, receive a screw 27 which fixes the length of the forearm strut 12 (as shown more clearly in FIG. 2 and 3).

As previously pointed out, the forearm strut 12 is attached through a hinge 14 to the telescoping upper arm strut 16. This hinge 14 is unique in that it has within it an adaptable spring tensioning device 35 shown in detail in FIGS. 3–6.

Figure 4:
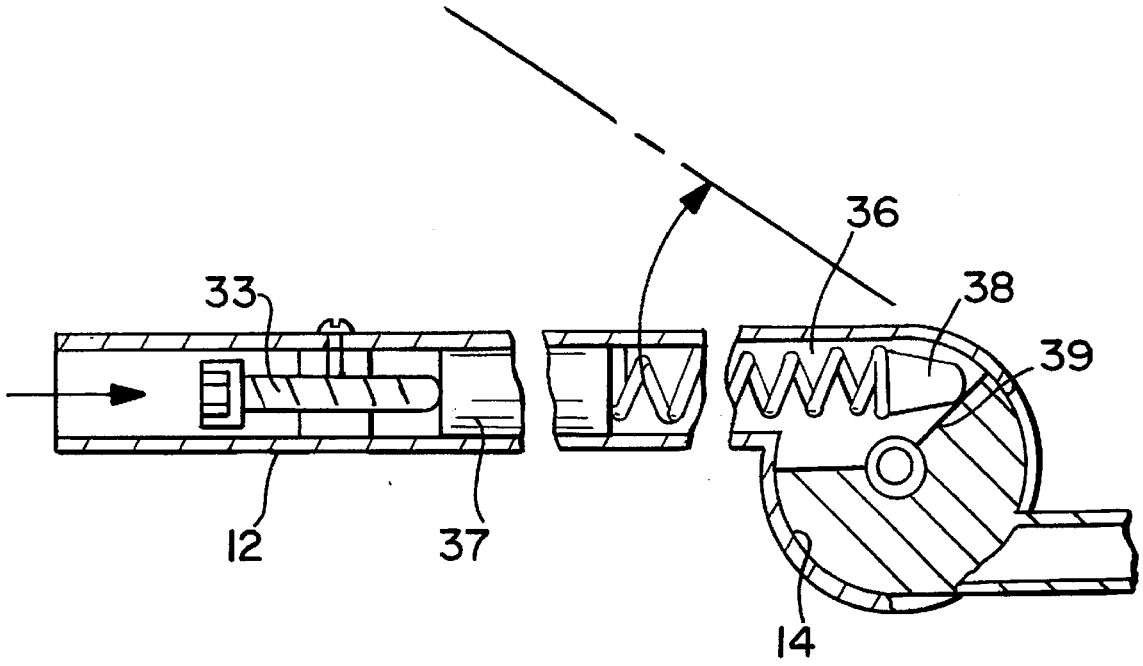
FIG. 4 is a longitudinal sectional view illustrating the elbow spring-loaded tension mechanism taken along 4—4 of FIG. 1.
Figure 5:
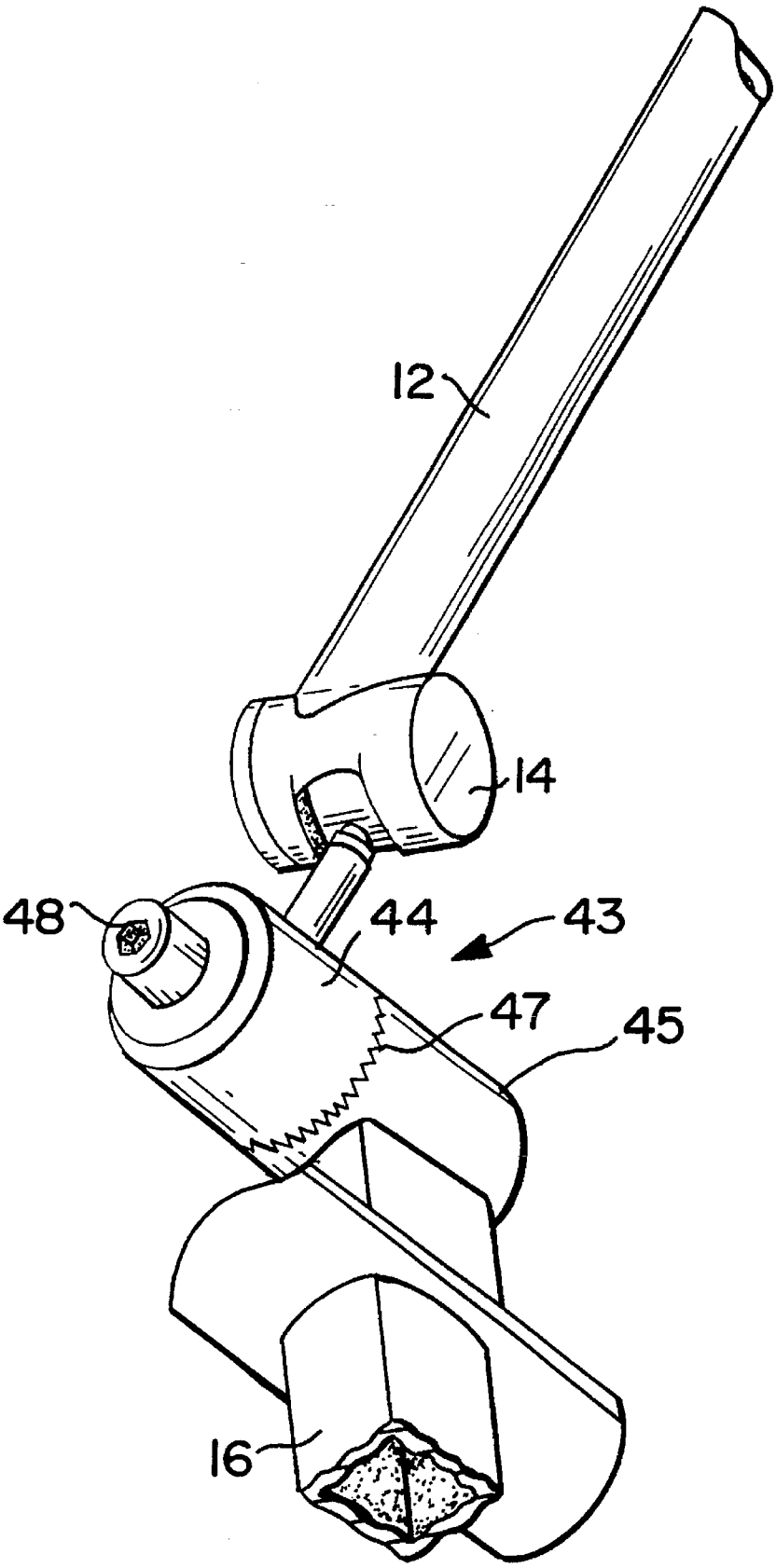
FIG. 5 is an enlarged perspective view illustrating the assembly of components of the elbow pivot or hinge and serrated positioning means.
Figure 6:
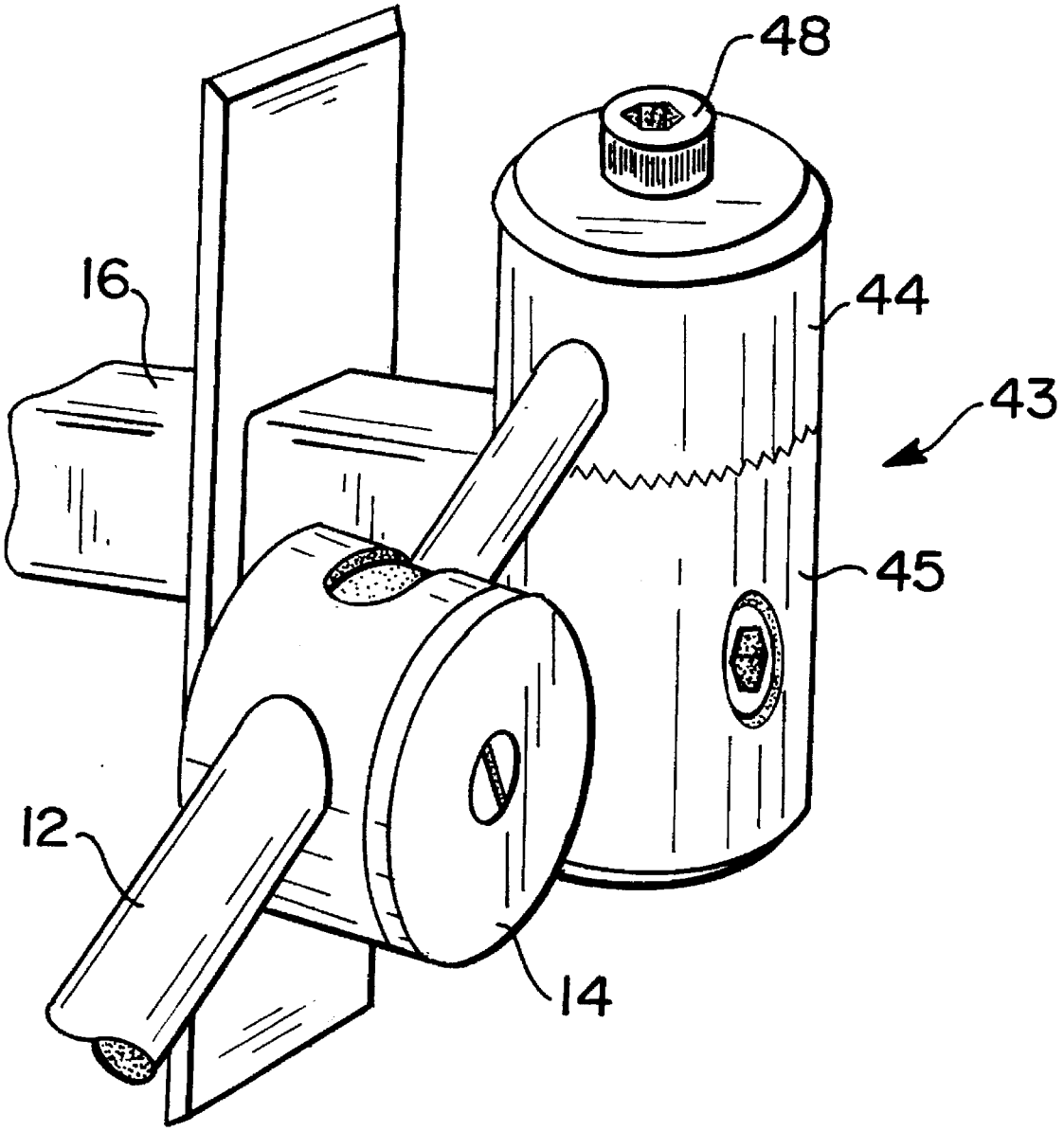
FIG. 6 is another perspective view of the elbow pivot and serrated positioning means taken from the opposite direction.

Referring particularly to FIGS. 3 and 4, the adjustable-spring tensioning device 35 (employed in the physical therapy device 10 of this invention) is not per se novel, but has been described in U.S. Pat. Nos. 4,508,111 and 4,947,835. However, the tensioning devices of the noted patents were supplied to provide either flexion or extension, and these prior devices are directed to elbows, knees and/or ankles not to shoulder therapy.

The tensioning device 35 (FIGS. 3 and 4) is an adjustable spring mechanism comprised of a spring 36 attached to a nose element 38 which bears on a cam surface 39. An adjustable screw 33 abuts a plunger 37 at the other end of the spring 36. The screw 33, when properly turned, produces a quantifiable force which tends to either extend or contract the spring 36. As maximum deflection or flexion is approached, compression is created in the compression-coiled spring 36. The adjustable screw 33 means, per se, is comprised of an "Allen" head screw or slotted head screw threaded to a spring-abutting member 37. The "Allen" head screw is fixed within strut 12 by a screw thread. The "Allen" head screw receives and is turned by an "Allen" socket wrench 41, whereas a slotted head screw is adjustable with a conventional screwdriver blade. The turning of the screw 33 creates greater compression of the spring 36, thereby exerting greater force on the cam surface 39 of the strut 12 to exert a one way tension. The tension capability of the spring mechanism can range from 0 pounds tension up to the maximum tension capable of the spring. In general, the tension of the spring mechanism will range from 0 pounds tension up to 10 pounds of tension and the tension exerted by the spring can be varied at any point of joint range of motion, say from 60° flexion to 0° flexion of the joint.

In the articulated device 10, there are at both the elbow hinge 14 and the shoulder pivot hinge 18, an adjustable spring-loaded tension mechanism designed to place varying amounts of stress or tension at the elbow and shoulder during physical therapy. In use, a quantifiable spring force on the cam causes pressure to be placed on the shoulder through the elbow pivot and the shoulder pivot. Depending on the directional arrangement of the cam, pressure is exercised during flexion or extension.

The amount of tension exerted by the spring 36 can be read on the visible scale 40 in the forearm strut 12 as well as at 58 in shoulder hinge assembly 57. The gauge for both the elbow and shoulder quantifiable spring mechanism is graduated in increments of 3; from 3 to 12: 3 on the gauge represents 1.05 ft. lbs. of pressure; 6 represents 2.28 ft. lbs. of pressure; 9 represents 3.43 ft. lbs. of pressure and 12 represents 4.78 ft. lbs of pressure.

In use the pressure applied is the minimum amount to provide tension and then is increased as the patient is able to accommodate more tension.

A unique feature of this device in the present application is the ability of this device to allow graduated, quantified, adjustable tension with the ability to relax the stretch away from the limit of flexion or extension. This will allow the tissue being stretched to have a rest period while not disturbing the adjustment of the spring tension and without having to remove the device. In order to relieve the pressure on the contractured tissues, one merely has to overcome, by any means, the tension in the splint and extend the joint to a comfortable posture. Once a short rest is achieved, the splint may again exert its tension against the contractured tissue to help accomplish a greater degree of flexion in the joint.

Between the forearm strut 12 and the reciprocating telescopic upper arm strut 16 is a strut angle adjusting means 43 (FIGS. 5 and 6) designed to accommodate the angle of the arm at the elbow. The strut angle adjusting means 43 has a top section 44 and a bottom section 45 joined by serrated teeth 47 in registry. To separate the top section 44 from the bottom section 45, the securing means 48 at the top section 44 is released thus separating the parts to adjust the angle. Once the angle is adjusted, the top 44 and bottom 45 sections can be rejoined using the securing means 48.

Figure 7:
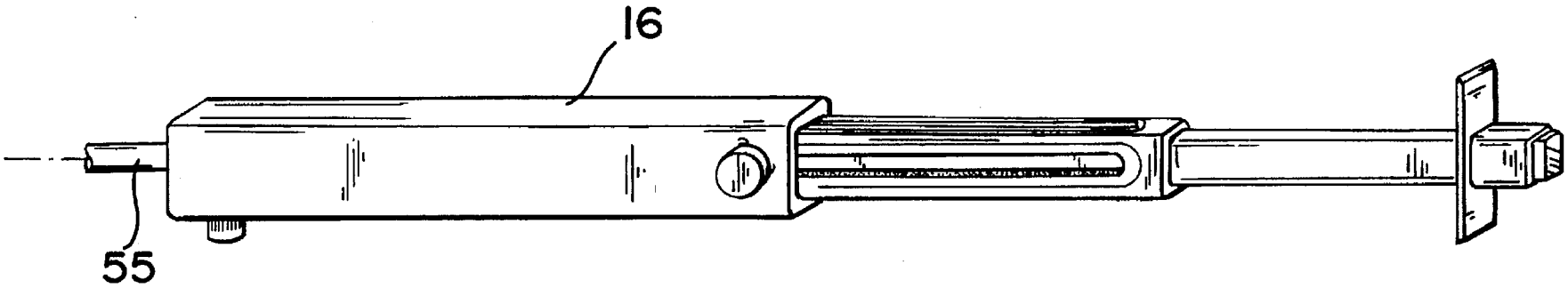
FIG. 7 and 8 are views illustrating the extended telescoping arm provided with the expanding accordion-pleated cover, shown in FIG. 8 in dashed lines.
Figure 8:
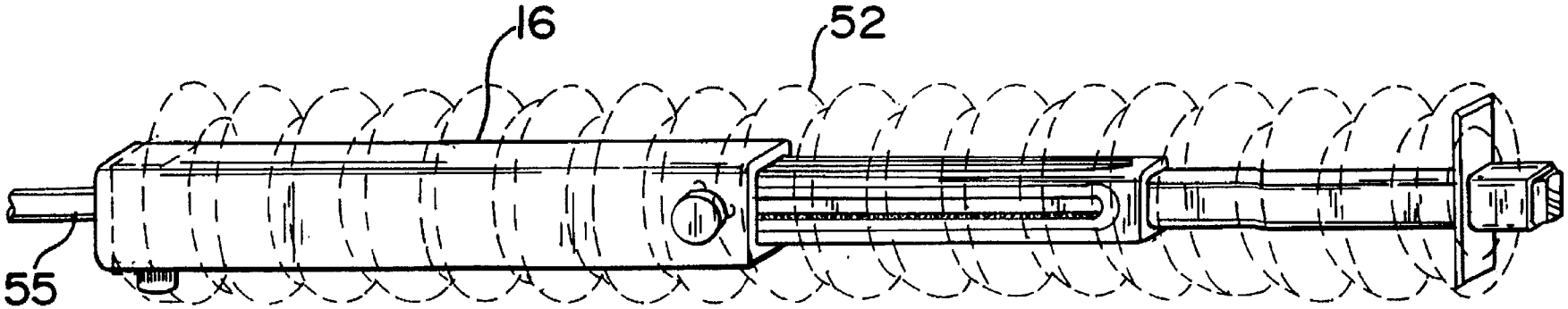
Figure 9:
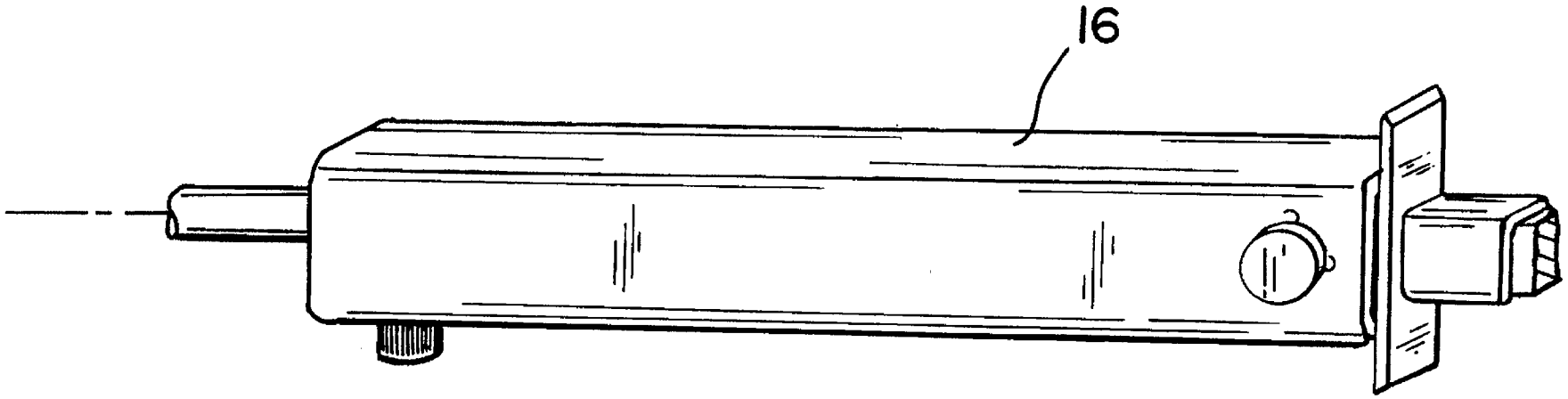
FIG. 9 is a view of the telescoping arm in the retracted position.
Figure 10:
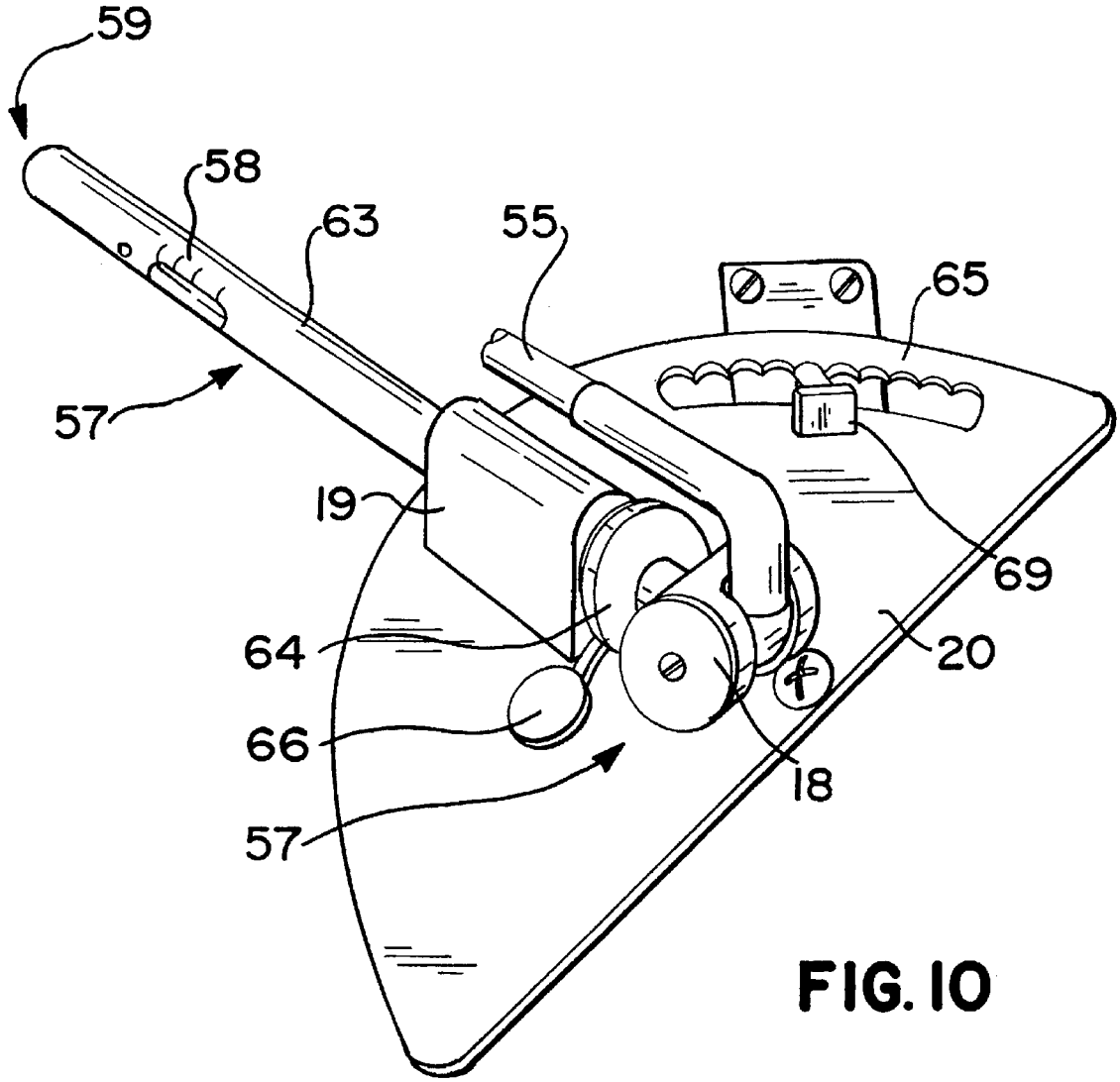
FIG. 10–12 are views of the shoulder pivot assembly with the shoulder spring loaded tension device.
Figure 11:
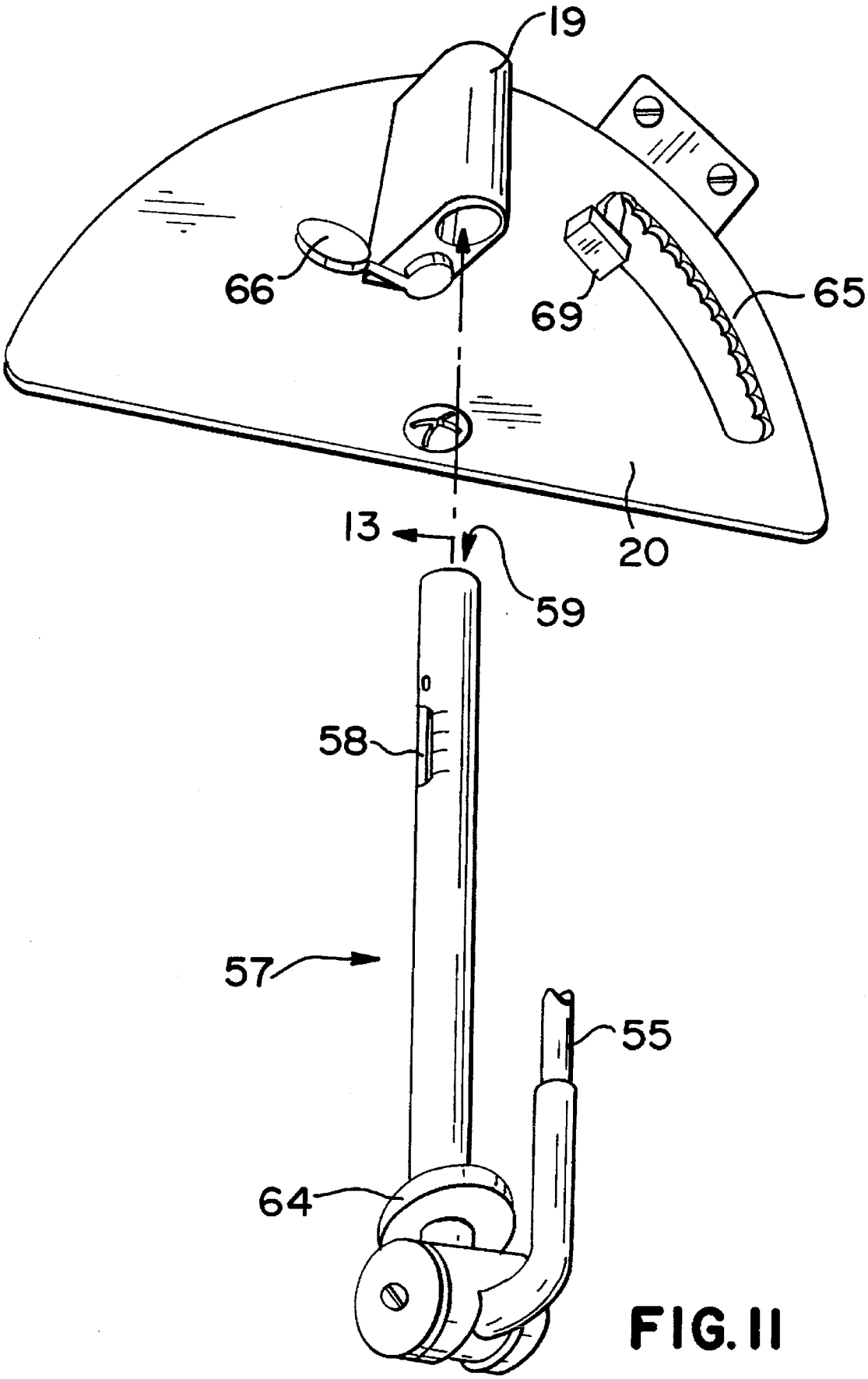
Figure 12:
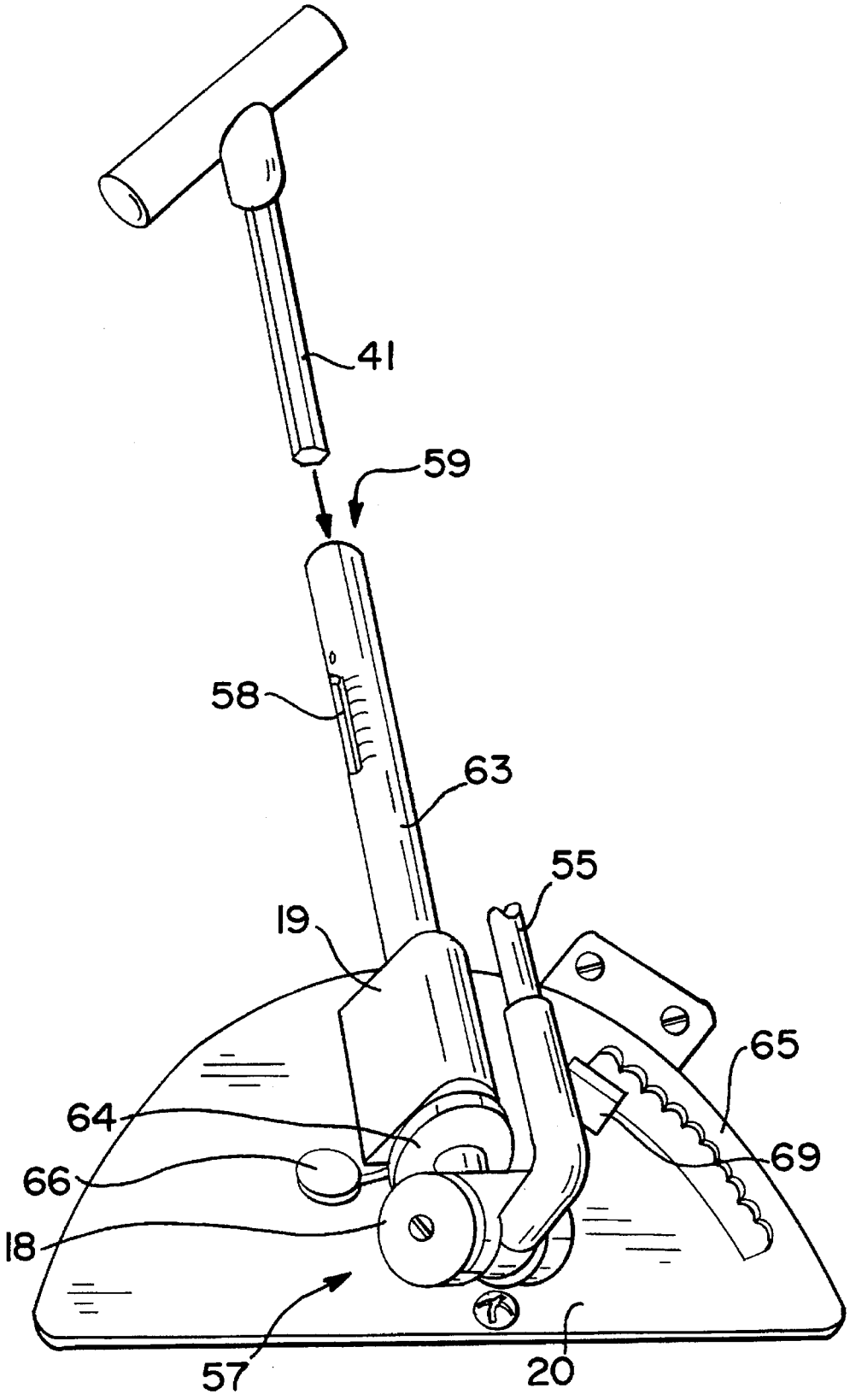

An elegant feature of the physical therapy device 10, is a reciprocating telescoping upper arm strut 16 (FIGS. 7–9). This reciprocating telescoping feature allows for flexion and extension at the shoulder. In FIG. 7, the telescoping strut 16 is in the extended position and in FIG. 9 the strut 16 is in the retracted position. There is an accordion pleated cylinder 52 covering the strut 16 as a protective means shown in broken lines in FIG. 8. As an alternative method for constructing the reciprocating telescoping upper arm strut, linear ball-bushings, scope plates with telescopic rod shafts can be used.

With reference to FIGS. 10–13, a joining member 55 joins the upper arm telescoping strut 16 to the spring tensioned pivotal shoulder hinge assembly 57. The assembly is retained in a retainer 19 affixed to the adjustable protractor 20 on the base 61 of the physical device 10. The spring tension housing 63 serves as the member inserted into the retainer 19 to position the articulated shoulder physical therapy device 10 on the base 61. The spring tension housing 63 inserted into the retainer 19 is fixedly secured in the retainer 19 by locking means 64 which locks around spring tension housing 63 to secure the physical therapy device in the retainer 19. The locking means 64 is held in place by detent 66. The locking means 64 is held securely around the spring tension housing 63. Once the device 10 is in the retainer 19 the device can be tilted 25° on either side of the vertical axis. This tilt is a further aid in providing the device with multiaxial direction.

More specifically the tilt of the device, 25° on either side of the vertical axis along with flexing hinge 18 (FIGS. 1, 10 and 12) allows the patient using the device to move the arm in the direction of abduction. As previously defined, "abduction" is defined as the movement away from the median axis of the body, such as raising an arm laterally or sideways.

Figure 13:
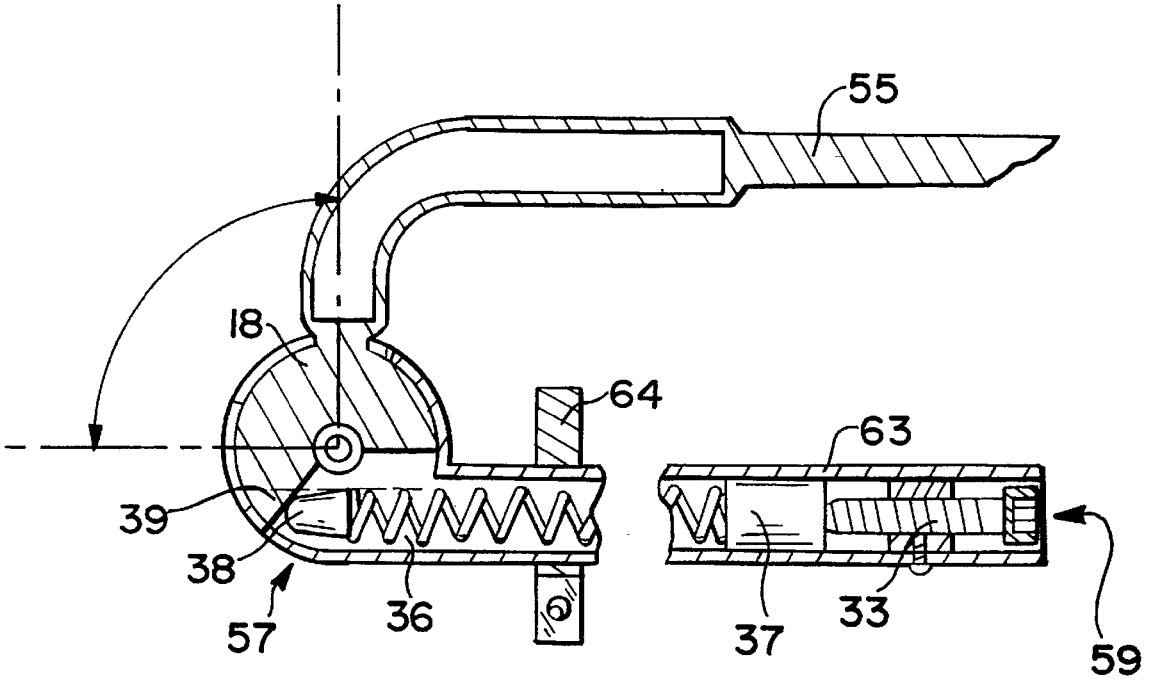
FIG. 13 is a sectional view of the cam mechanism of the spring loaded tension device taken along 13—13 of FIG. 11.
Figure 14:
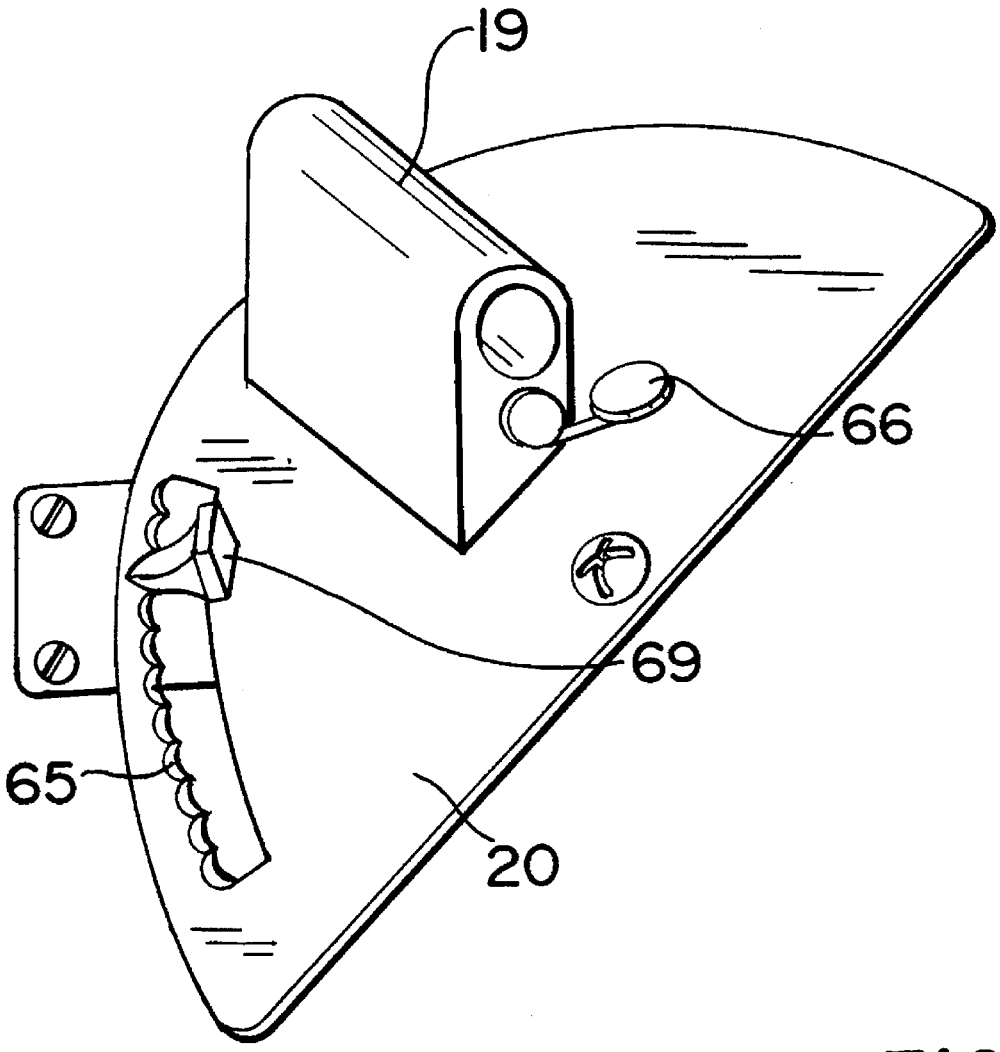
FIG. 14 of the calibrated protractor rotation device and retainer.

The spring tensioned shoulder hinge (FIGS. 10–13) has a quantifiable spring tensioning means shown in cross-section in FIG. 13 and is not unlike that shown for the elbow in that there is a spring 36, a nose element 38, a plunger 37 and a tensioning screw 33 to force the nose element 38 to exert pressure on the cam surface 39. The pressure at the shoulder is exerted on elevation of the upper arm. The quantifiable spring tension means is accessed at 59 in the spring tension housing 63 with Allen wrench 41.

The protractor 20, to which is joined the pivotal hinge 18 is calibrated with calibration gauge 65 to gauge the abduction of the arm from the vertical axis of the body. In use the protractor 20 will be set at a value which is comfortable for the patient taking into account that the shoulder is frozen and lacks mobility. To move the protractor 20 in order to change the angle, the protractor lock 69 is released and the protractor 20 turned by grasping the retainer means 19. The protractor can move through a range of 0° to 70°.

Figure 15:
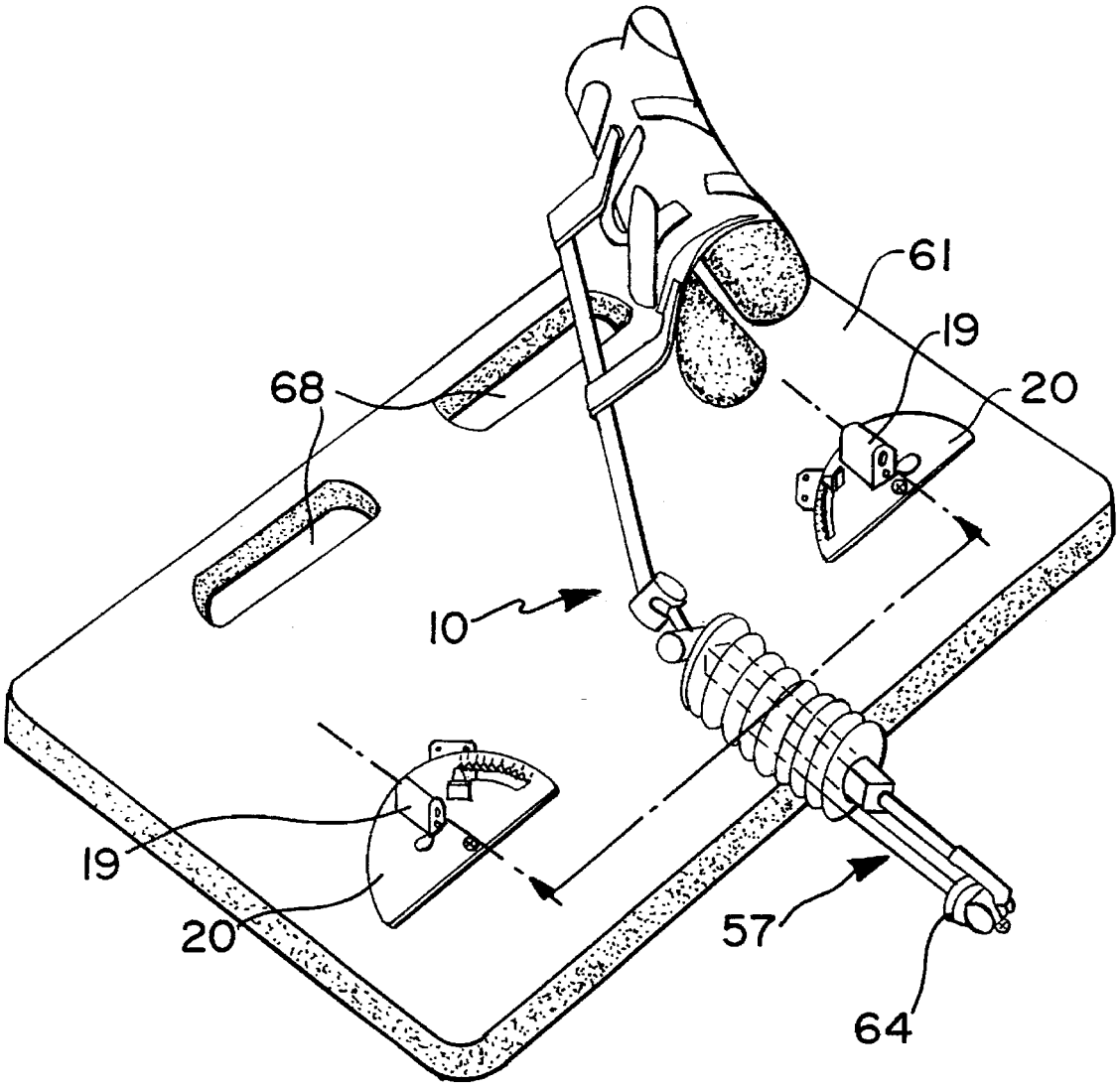
FIG. 15 is a view of the base with two protractor devices.
Figure 16:
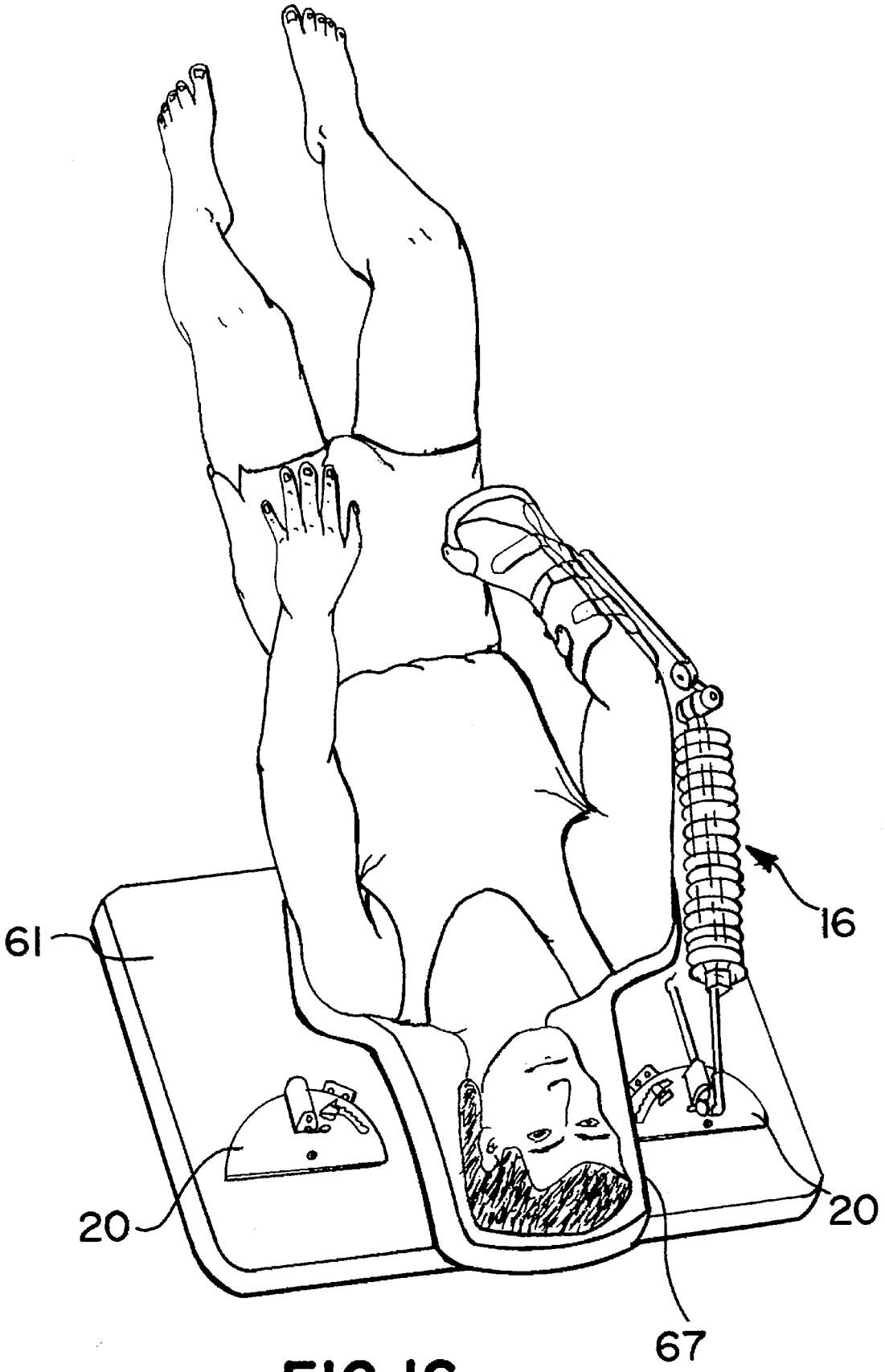
FIG. 16 and 17 are views illustrating the use of the device on the right shoulder and left shoulder.
Figure 17:
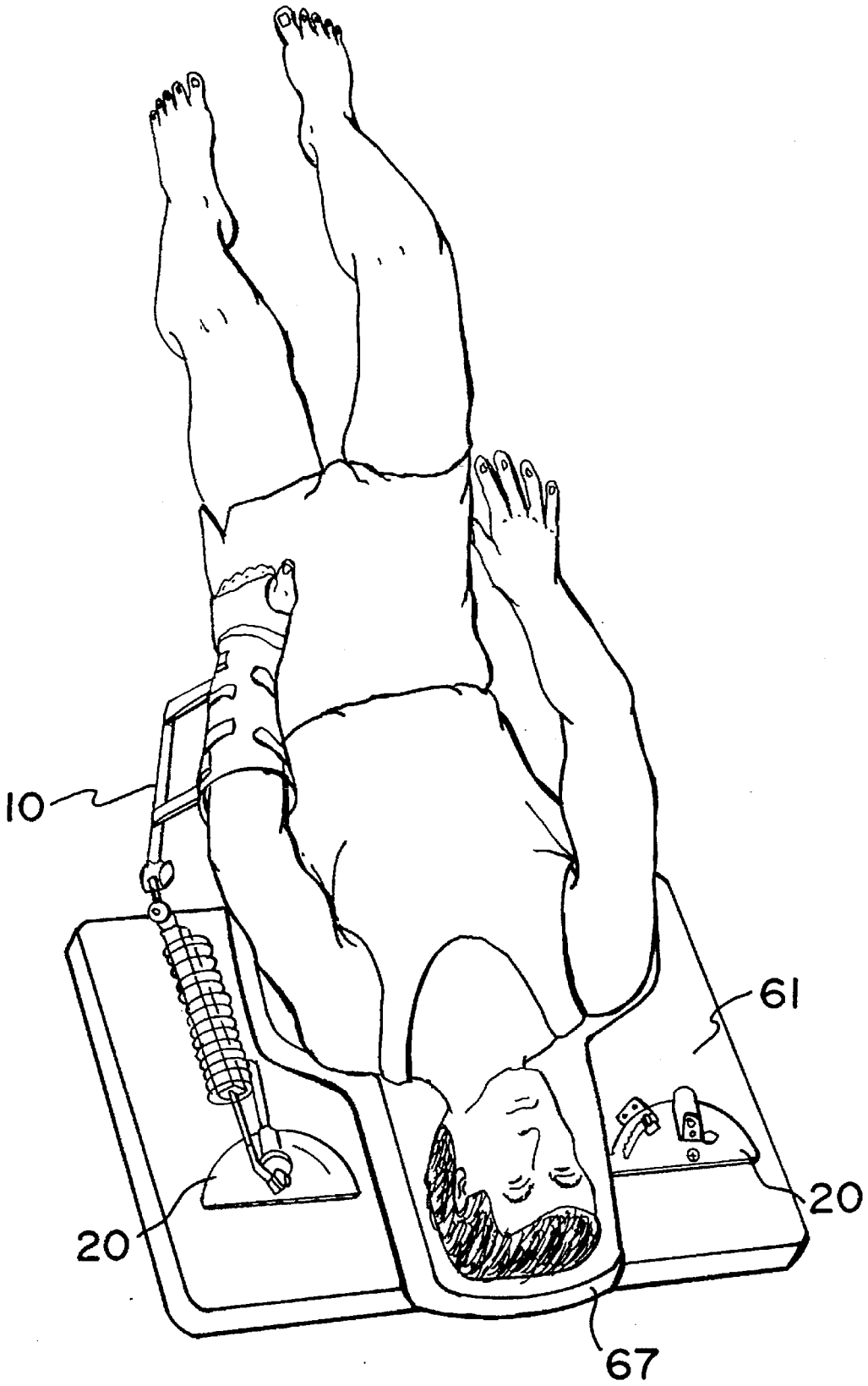

The protractor 20 and the pivotally hinged mechanism 18 are attached to a flat base 61. The flat base 61 can be made of wood or plastic or a like material which could support the attached members of the physical therapy device. As a unique feature (FIG. 15), there are attached to the base two protractors 20, one for the left shoulder and the other for the right shoulder. Each protractor 20 has attached thereto a physical therapy device retainer 19. This allows a single articulated physical therapy device 10 to be used on each side of the base. One side for the left shoulder and the other side for the right shoulder. Attached on top of the base is a head and shoulder support pad 67 (FIGS. 16 and 17) for comfort of the user. For convenience of moving the physical therapy device from place to place, there is supplied cutout carrying handles 68.

Figure 18:
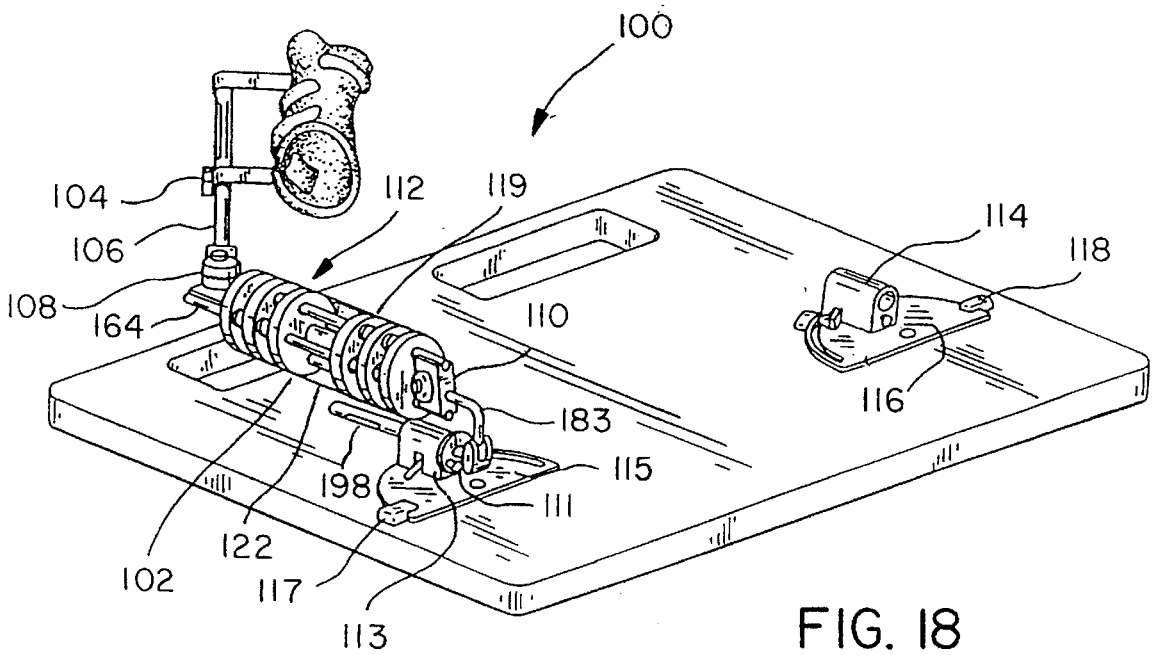
FIG. 18 is an isometric view of the preferred embodiment frozen shoulder physical therapy device.
Figure 19:
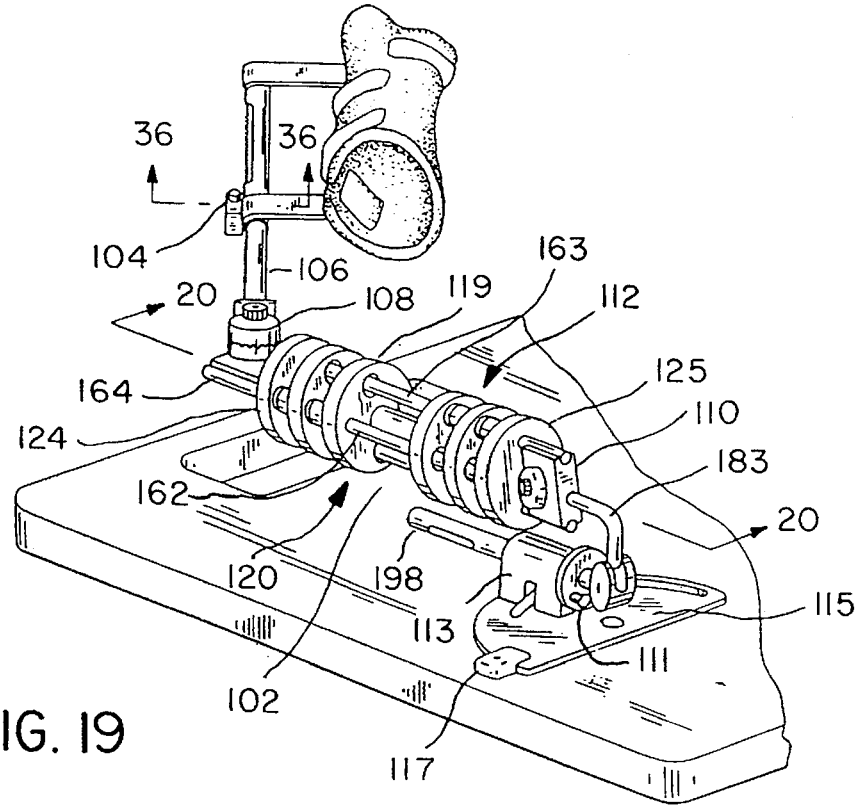
FIG. 19 is an enlarged view of the preferred embodiment frozen shoulder physical therapy device with part of the base broken away. The tube of the reciprocating telescoping subassembly has been removed to better show the reciprocating mechanism.

With reference to FIGS. 18 and 19 the preferred embodiment shoulder physical therapy device 100 has many improvements and advantageous features. The most elegant feature of improvement is a reciprocating telescoping upper arm strut 102. In addition, there is an improved cam-actuated detent mechanism 104 for easily adjusting the length of the forearm strut 106. There is also provided a serrated knuckle 108 for the adjustment of the angle of the device at the user's elbow. An arrangement 110 is provided for adjusting the length of the upper arm strut. The preferred embodiment of the device 100 has an elegant detent assembly 111 for easy removal and attachment of the physical therapy strut assembly 112 from left shoulder protractor retaining unit 113 to right shoulder protractor retaining unit 114. The protractors 115 and 116 are provided with protractor guides 117 and 118 to stabilize and guide protractors 115 and 116 during angle adjustment. The head and shoulder support pad 67 (FIGS. 16 and 17) can be used with the preferred embodiment physical therapy device 100.

Figure 20:
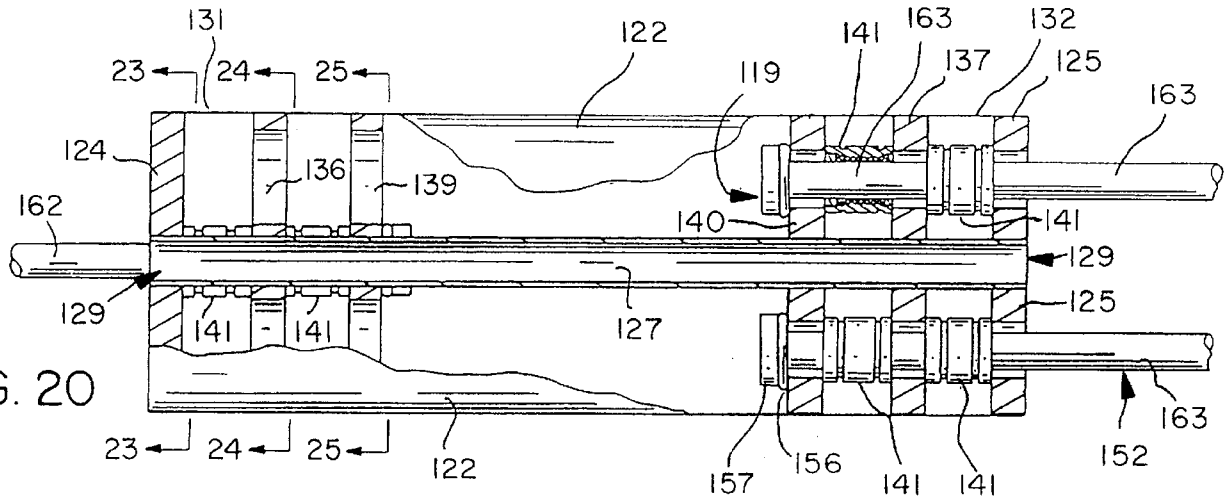
FIG. 20 is a longitudinal section of the preferred reciprocating telescoping upper arm strut subassembly fully extended taken along lines 20—20 of FIG. 19. Most of the tube surrounding the scope plates and rods has been broken away to better show the reciprocating mechanism. A linear ball bearing is shown in longitudinal section.
Figure 20A:
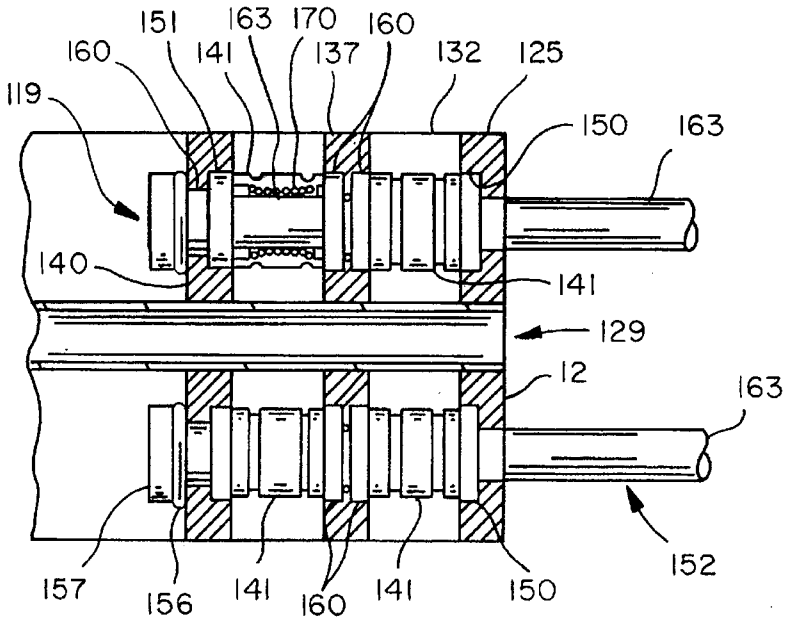
FIG. 20A is an enlarged view of the right side of the telescopic upper arm strut of FIG. 20 showing how the recirculating ball linear bearings fit into the counter bore of the scope plates.
Figure 21:
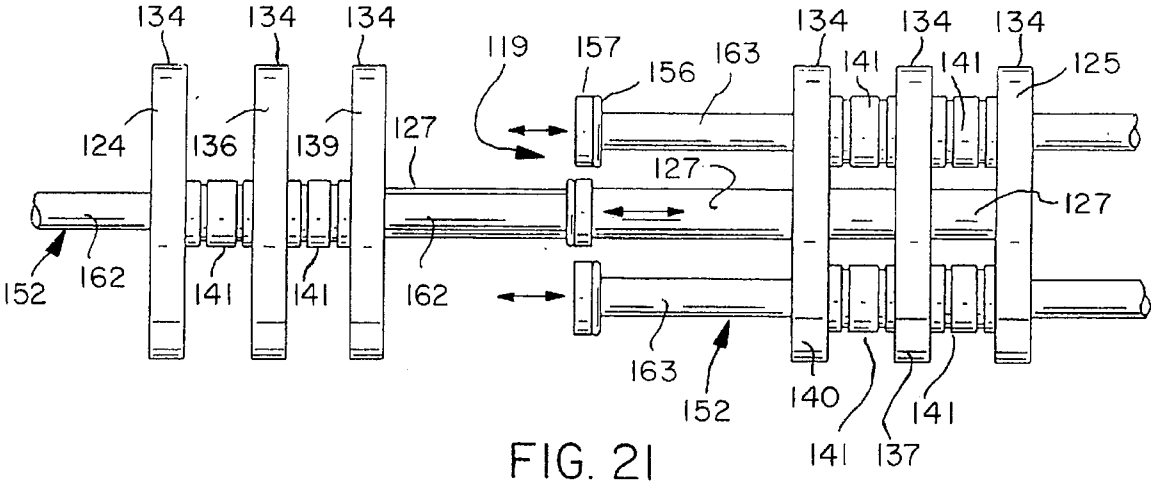
FIG. 21 is a side elevational view of the preferred reciprocating telescoping upper arm strut subassembly partially extended. The tube has been omitted to better show the reciprocating mechanism. The arrows show the direction of movement of the rods during reciprocation.
Figure 22:
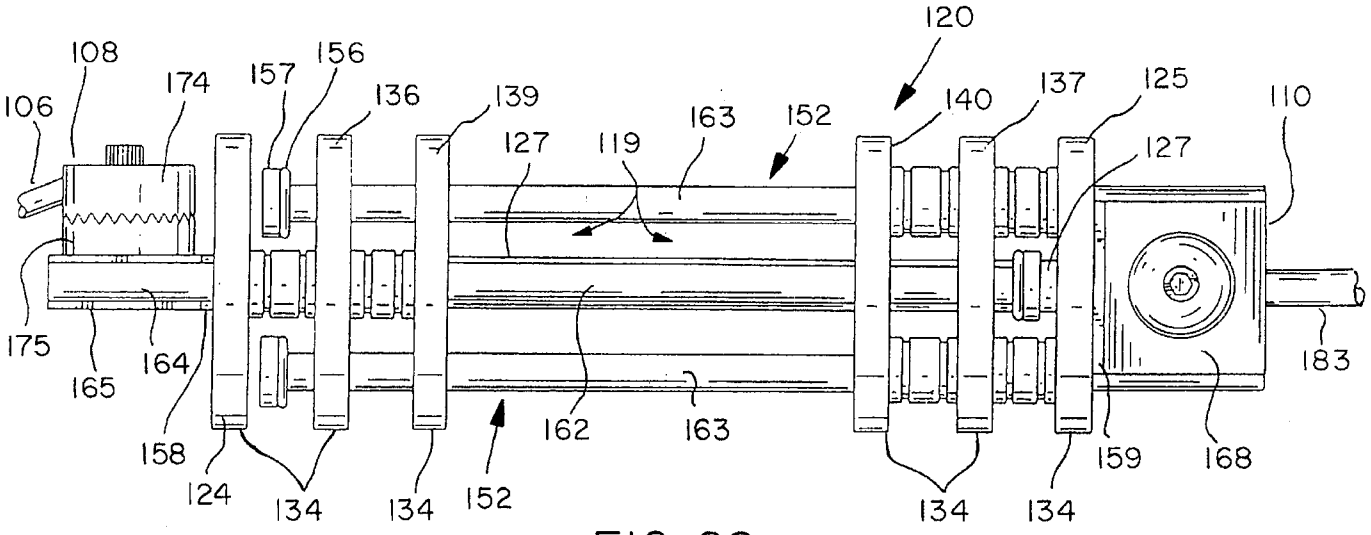
FIG. 22 is a side elevational view thereof fully retracted. The tube has been omitted to better show the reciprocating mechanism.
Figure 23:
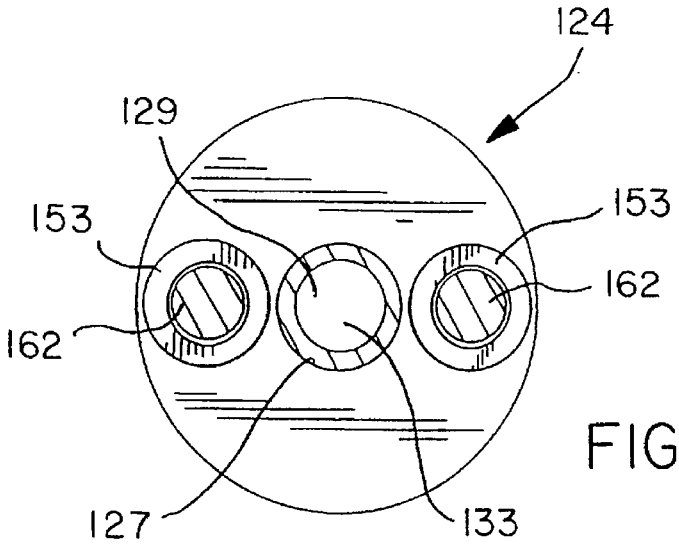
FIG. 23 is a cross-section taken along lines 23—23 of FIG. 20.
Figure 24:
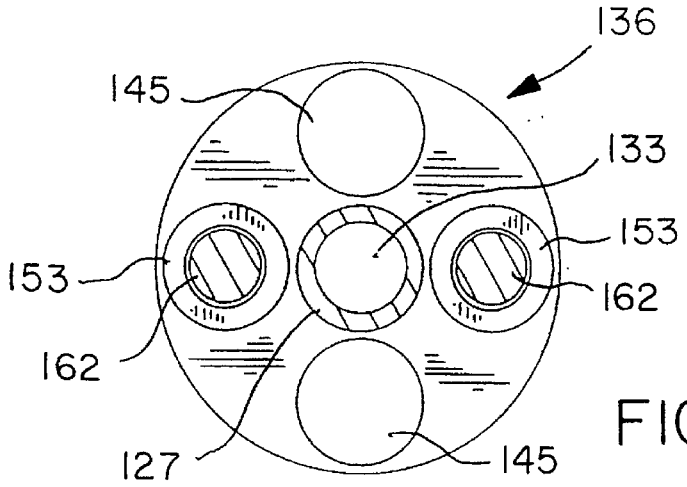
FIG. 24 is a cross-section taken along lines 24—24 of FIG. 20.
Figure 25:
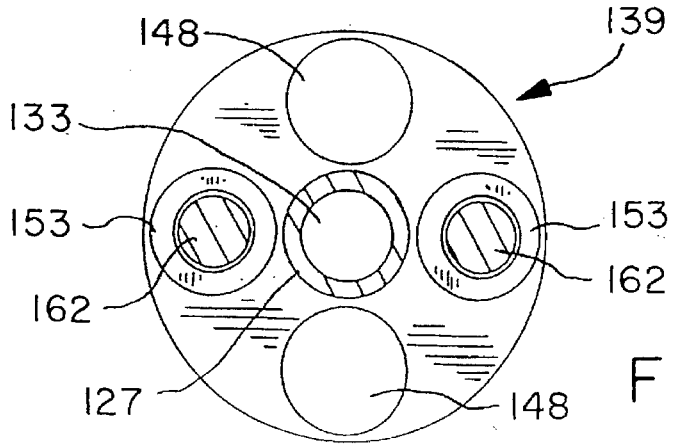
FIG. 25 is a cross-section taken along lines 25—25 of FIG. 20.

Referring to FIGS. 20–22, the reciprocating mechanism 119 of the reciprocating telescopic subassembly 120 is encased in a cylindrical scope tube 122 (shown broken away in FIG. 20). The tube 122 may be made of a transparent or opaque material. The reciprocating telescoping subassembly 120 of the upper arm strut 102 has a cylindrical scope tube 122 provided at either end with external scope plates 124, 125. The scope plates 124, 125 are joined to a hollow scope support tube 127 (FIGS. 20–22). The hollow scope support tube 127 is fixedly attached at the hole 129 in the center of each external scope plate 124, 125 and runs centrally along the longitudinal axis of the cylindrical scope tube 122. In the embodiment shown (FIG. 20) the cylindrical scope tube 122 is attached and held in place on the external scope plates 124, 125 by screws, however other securing means, such as welding or cementing would be operative. The external scope plates 124, 125 can be attached to scope support tube 127 by welding or like means.

Referring particularly to FIG. 20, the cylindrical scope tube 122 has a left end portion 131 and a right end portion 132, along with the scope support tube 127 attached at the hole in the center 129 of each of the circular external scope plates 124, 125. Besides the external scope plates 124, 125, within the tube 122 are a series of circular scope plates or plates 136, 137, 139, 140 (FIGS. 23–33). As noted at either end of the scope tube 122 are circular external scope plates 124, 125 attached to the scope support tube 127 and sealing ends 131 and 132 of the cylindrical scope tube 122. Fixed in tube 122, inboard of the circular external scope plates 124, 125 at both ends of the tube 122 are intermediate scope plates 136 and 137 and further inboard of the intermediate scope plates 136 and 137 are internal scope plates 139 and 140. Thus there are a set of three scope plates 134 on each end of the cylindrical tube 122. The plates 134 are placed in a transverse relationship to the longitudinal axis of the cylindrical scope tube 122 and are positioned on the scope support tube 127 through the center hole 133 (FIGS. 23–33) in each scope plate 134. The external plates 124, 125 and the internal plates 139, 140 are welded to the scope support tube 127. The intermediate plates 136, 137 are not welded, but are held positioned between the welded external plates and internal plates by the roller ball bearings 141 (FIGS. 20–22).

Figure 26:
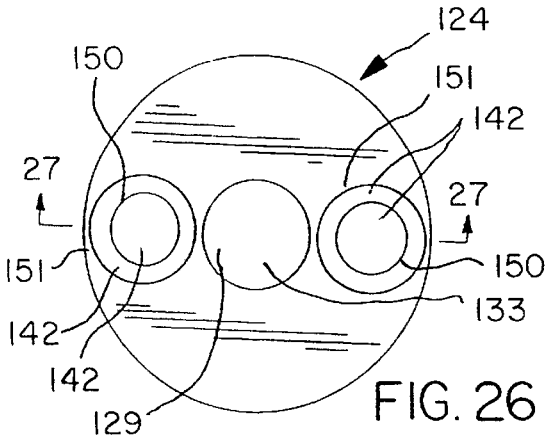
FIG. 26 is a plan view of an external scope plate.
Figure 27:
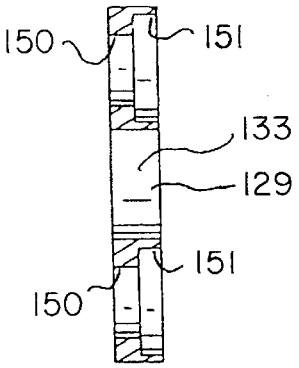
FIG. 27 is a cross-section taken along lines 27—27 of FIG. 26.
Figure 28:
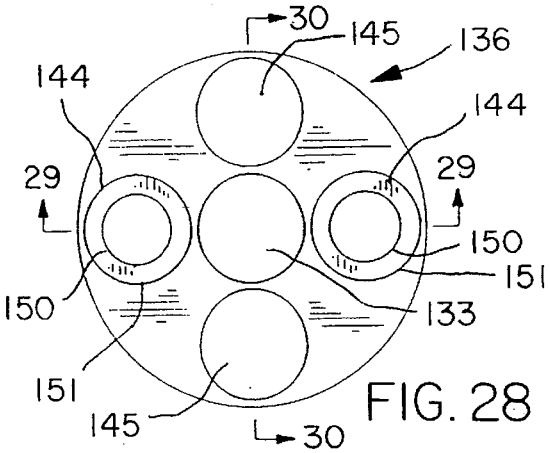
FIG. 28 is a plan view of an intermediate scope plate.
Figure 29:
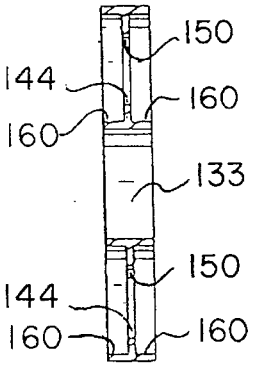
FIG. 29 is a cross-section taken along lines 29—29 of FIG. 28.
Figure 30:
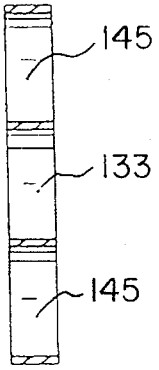
FIG. 30 is a cross-section taken along lines 30—30 of FIG. 28.
Figure 31:
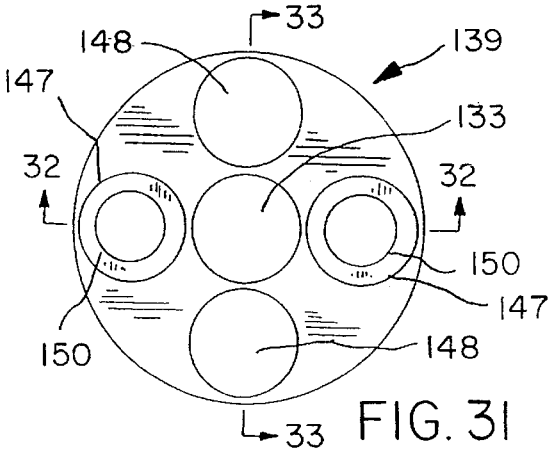
FIG. 31 is a plan view of an internal scope plate.
Figure 32:
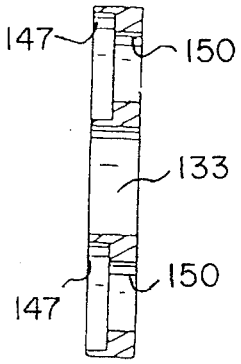
FIG. 32 is a cross-section taken along lines 32—32 of FIG. 31.
Figure 33:
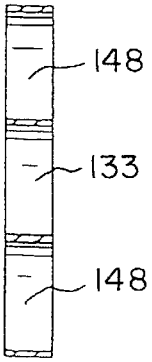
FIG. 33 is a cross-section taken along lines 33—33 of FIG. 31.
Figure 34:
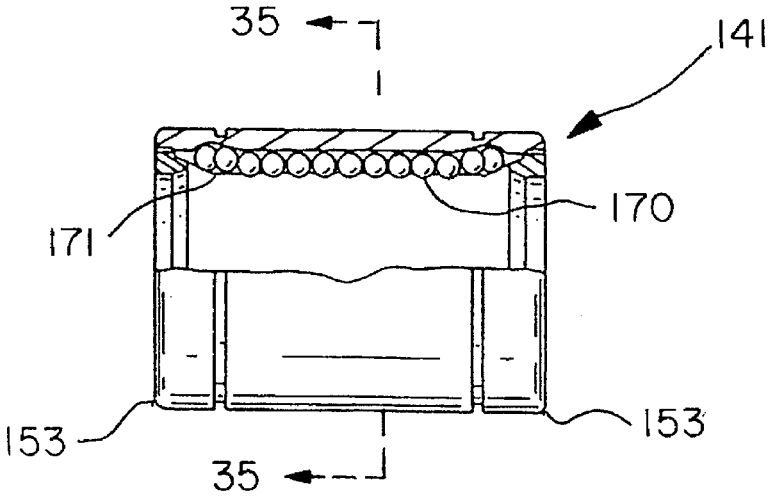
FIG. 34 is a side elevational view of the linear ball bearing with part of the bearing wall broken away to show the internal linear ball bearings.
Figure 35:
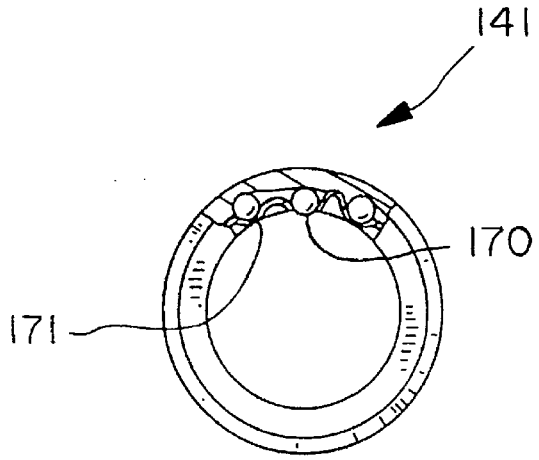
FIG. 35 is a cross-section view of the linear ball bearing taken along lines 35—35 of FIG. 34.

With reference to FIGS. 23–33, the left side plates are described. Each scope plate 134 has therein sets of holes. Referring specifically to FIGS. 26 and 27 external plate 124 has two counterbored holes 142 in a horizontal plane. Intermediate plate 136 has four holes; two double opposing counterbored holes 144 in a horizontal plane and two larger holes 145 in a vertical plane (FIGS. 28–30). An internal plate 139 (FIG. 31–33) has four holes; two counterbored holes 147 in a horizontal plane and two larger holes 148 in a vertical plane. The scope plates (FIGS. 26–33) are provided with counterbored holes 142, 144, 147. In each instance the bore 150 of the counterbored holes is of such size as to yieldably engage the reciprocating rods 152 while the counterbore 151 is of such size as to receive the sleeve end 153 of the roller ball bearing 141.

The larger vertical holes 145, 148 in the intermediate and internal plates (FIGS. 28–33) allow the bumper 156 and flange 157 on the ends of the rods 152 to pass through unobstructed during reciprocal motion (arrows FIG. 21).

Particularly, with reference to FIGS. 26–33 the relationship between the bores 150 and the counter bores 151 is more precisely illustrated. The external scope plate 124 (FIG. 26) and internal scope plate 139 (FIG. 31) have counterbored holes 142 and 147 while the intermediate scope plate 136 (FIG. 28–30) has opposing counterbored holes 160 on the front and back flat surface of the plate 136. The bore 150 in each of the plates 134 yieldingly engages rods 152 and the counterbore 151 on each surface receives a sleeve end 152 of a roller ball bearing 141.

Figure 19A:
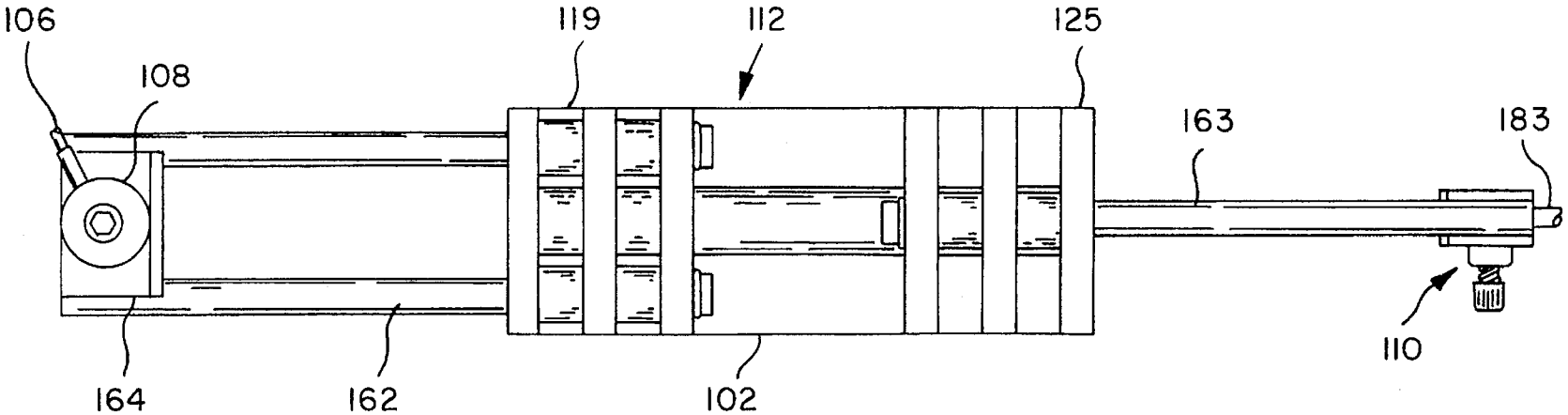
FIG. 19A is a side elevational view of the reciprocating telescopic upper arm strut in an extended position.
Figure 19B:
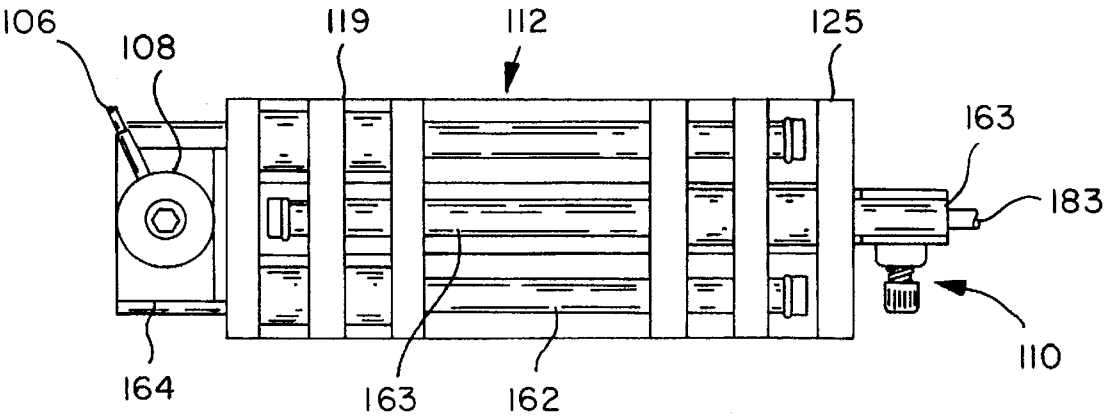
FIG. 19B is a side elevational view of the reciprocating telescopic upper arm strut in a retracted position.

Referring to FIGS. 19–22 the reciprocating telescoping upper arm subassembly 120 is provided with four rods 152. There are a set of two parallel rods on the left 162 and a set of two parallel rods on the right 163. The rods on the left 162 are positioned in a horizontal plane and those on the right 163 in a vertical plane. With the subassembly 120 fully extended (FIGS. 19A and 20) the rods 162 and 163 extend out of the tube 122 and external scope plates 124 and 125; with the subassembly 120 in the retracted position (FIGS. 19B and 22) the rods 162 and 163 are positioned within the cylindrical tube 122. In the view shown in FIG. 21, the rods 162 and 163 of the subassembly 120 are partially extended, thus the rods are partially within the tube 122 and partially out of the tube 122.

Four recirculating ball linear bearings 141 (FIGS. 20–22 and 34–35) are provided for the rods 152 on each side of the reciprocating telescopic upper arm strut sub-assembly 120. The bearings 141 are set between the scope plates 134 (FIGS. 20A and 20–22). These bearings are commercially available. The balls 170 of these bearings 141 circulate on tracks 171 and longitudinally contact the rods 159 in four parallel lines 90° apart. Within the tracks 171 the bearings 141 can make many revolutions depending on the distance traveled by the rods 152 during reciprocating motion. The roller ball bearings 141 allow for smooth friction-free reciprocating of the rods 159 in the reciprocating telescoping subassembly 120.

Figure 38:
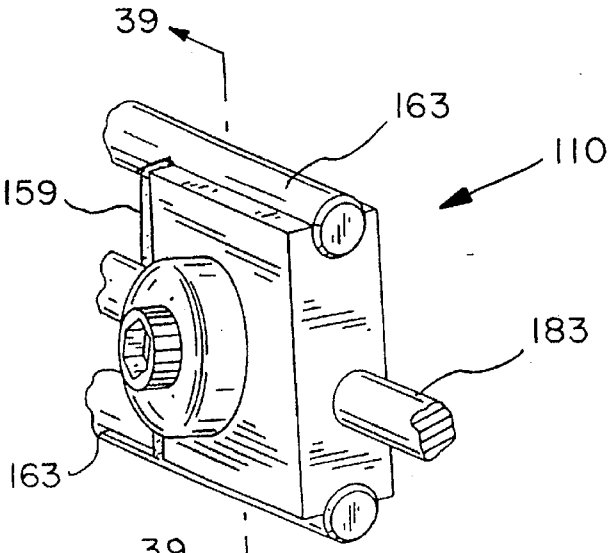
FIG. 38 is a perspective view of the attaching means for attaching the preferred reciprocating telescopic upper arm strut sub-assembly to the joining member of the shoulder hinge.

The internal ends of the rods 152 are flanged 157 and supplied with rubber bumpers 156 to relieve shock on the internal scope plates 139, 140 when the rods 152 are fully extended during reciprocation. There is also a rubber bumper 158 supplied at the serrated knuckle 108 (FIGS. 22 and 37) and a bumper 159 supplied at the upper arm adjusting arrangement 168 (FIGS. 22 and 38).

In reciprocating action (FIG. 21) the set of rods 163 on the right side of the tube 122 proceed through the aligned vertical large through holes 148 of the left internal scope plate 139, and left intermediate scope plate 136. The set of rods on the left 162 follows the same sequence as those on the right 163, the only difference being that the left rods 162 are horizontal, in a 90° rotated position. Of course, if necessary the degree of rotation can vary.

Figure 39:
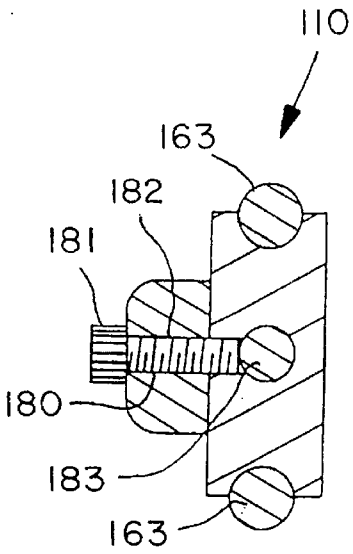
FIG. 39 is a cross-section taken along lines 39—39 of FIG. 38 showing the internal portion of the attaching means for attaching the preferred reciprocating telescoping upper arm strut subassembly to the joining member of the shoulder hinge.
Figure 37:
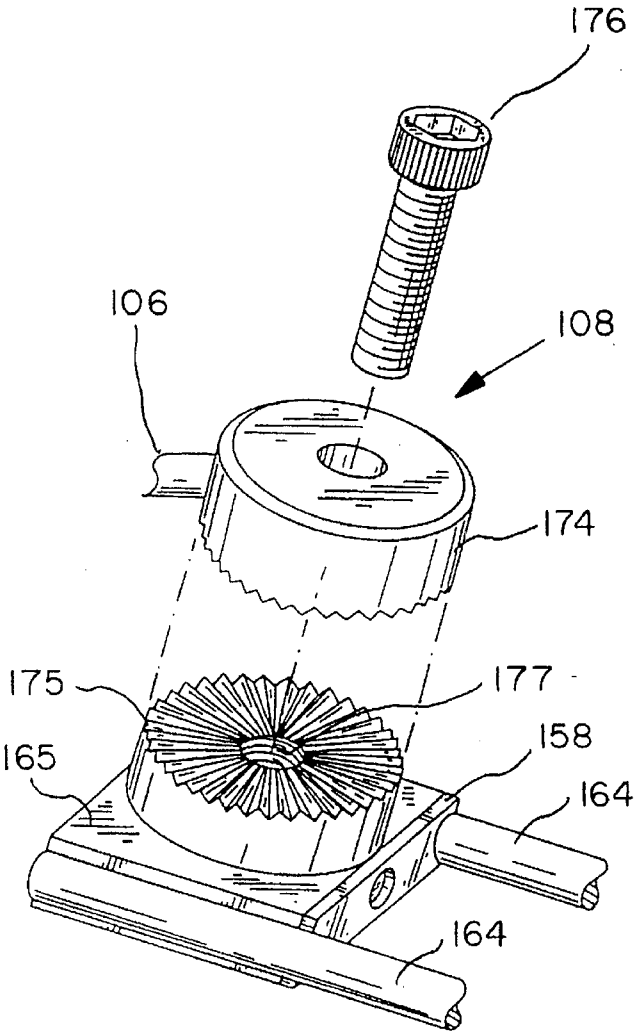
FIG. 37 is an exploded view illustrating the elbow knuckle or elbow angle adjusting means.

Referring to FIGS. 19, 22 and 37 the external end 164 of the two rods on the left side 162 of the reciprocating telescoping subassembly 120 project out of the cylindrical tube 120 and are fixedly attached (e.g. by welding or screws) to the mounting base 165 of a serrated knuckle joint 108 (FIGS. 22 and 37). The external ends 167 of the two rods 163 on the right side of the telescoping subassembly project out of the right side cylindrical tube 120 and are fixedly mounted to the upper arm length adjusting means 168 (FIGS. 38 and 39).

In the final construction of the reciprocating telescoping upper arm subassembly 120, the left external scope plate 124 is positioned in the left end of the cylindrical scope tube 122. Inboard of the external scope plate 124 are placed the intermediate scope plate 136 and the internal scope plate 139, respectively. The bores 150 of the counterbored holes in the three scope plates 134 are aligned to receive the rods 152. The counterbored holes 151 in the scope plates are aligned to receive the sleeve 153 of the roller ball bearing 154. The counterbore of the external plate is in registry with the counterbore 160 of the facing intermediate scope plate 136, and the counterbore 151 of the internal scope plate is in registry with the counterbore 160 of the opposite facing of the intermediate scope plate. The roller ball bearings 154 of the subassembly are received and retained in their respective counterbores 151 in the scope plates 134. The bores 150 of the counterbored holes yieldingly receive the reciprocating rods 152. The four ball bearings on either side of the cylindrical scope tube 122 receive the reciprocating rods and with the position of the bearings fixing the distance between the scope plates.

Bear in mind that the scope plates and rods on the left end of the scope tube are identical to those on the right. The sets of scope plates are in a converse or opposing relationship to each other and are respectively rotated 90° on their central axis.

Referring to FIGS. 19, 22 and 37 the forearm strut 106 is joined to the upper arm strut 172 with a sectional serrated knuckle 108. The knuckle has an upper serrated section 174 which can joined in registry with a lower serrated section 175 (FIG. 37). The left rods 164 of the telescoping subassembly 120 are joined to the knuckle at the mounting base 165 of the knuckle. The upper serrated section 174 is fixedly joined to the lower serrated section 175 with a threaded bolt 176 which screws into a tapped hole 177 in the lower serrated section 175 of the knuckle 108.

In operation the two sections 174, 175 of the knuckle 108 are set to form a comfortable angle to accommodate the angle of the patient's or user's elbow.

Referring to FIGS. 19, 22, 38 and 39, the two reciprocating rods on the right side of the tube 122 are securely attached outside of the tube 122 to an upper arm length adjusting means 110. The upper arm length adjusting means 110 has a tapped hole 180 receiving a screw 181. The tapped hole has a channel 182 running therethrough at right angles to the tapped hole 180. The shoulder hinge joining member 183 is inserted in the channel 182 to a depth accommodating the length of the arm of the user and then the screw 181 in the tapped hole 180 is tightened to secure the joining member 183 to the reciprocating telescoping subassembly 120.

Figure 36:
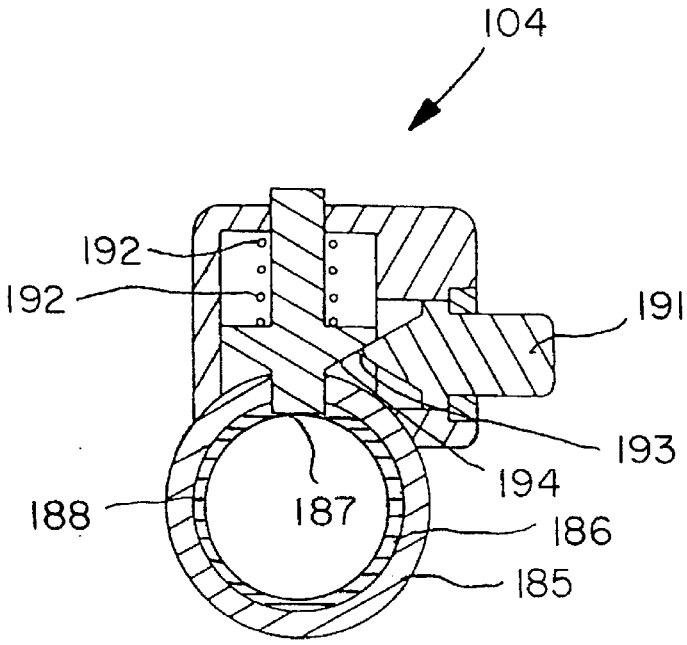
FIG. 36 is a cross-section taken along lines 36—36 of FIG. 19 of the cam-actuated detent mechanism employed to adjust the length of the forearm strut.

With reference to FIGS. 19 and 36 the forearm strut 106 is adjustable as to length. The length is adjusted by telescopically sliding the larger outside 185 portion of the forearm strut 106 (FIG. 36) over a smaller inside portion 186 of the strut 106 and locking the strut into the desired position with a detent 187. The smaller inside portion 186 of the strut along its longitudinal dimension has spaced keeper holes 188 to receive the aligned latch locking pin or detent 187 of the detent assembly 190.

The cam actuated detent assembly 190 is fixedly attached on the outer tube 185 of the forearm strut 106. In operation the length of the forearm strut 106 is adjusted by releasing a cam operated lock pin or detent 187 by pressing in on a button 191 to release the detent 187. The telescopic portions 185, 186 of the forearm strut 106 are moved to the desired length and detent 187 is released into a proper keeper hole 188. Specifically, the detent mechanism assembly 104 is an arrangement of a cam 193, release button 191 and a spring seated detent 187. In the locked position in which the two sections of tube of the forearm strut are releasably joined, a spring 192 keeps the detent 187 in the keeper hole 188 of inner tube 186 of the forearm strut 106. To release the detent 187 from its keeper 188, one pushes on the cam-actuated release button 191. The cam 193 attached to the release button 191 presses on the angular surface 194 of the detent, thus overcoming the spring 192 pressure holding the detent 187 in place. With the spring 192 pressure overcome the detent 187 is raised and the outer tube 185 of the forearm strut 104 is released and can be moved along the surface of the inner-tube 186 for adjustment.

Referring to FIGS. 19 and 40–44, the physical therapy strut assembly 112 is joined to a protractor 115 through a protractor retainer 113 mounted on the protractor 115. The retainer 113 is provided with a passage 197 (FIGS. 41 and 42) through which the spring tension housing 198 at the end of the upper arm strut is inserted to secure the upper arm portion of the physical therapy strut assembly 112 to the protractor 115.

Figure 43:
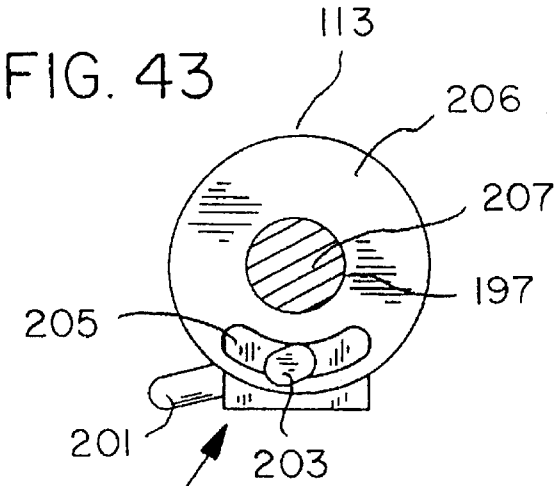
FIG. 43 is an end elevational view showing the shoulder retaining unit and detent latch in the locked position.
Figure 44:
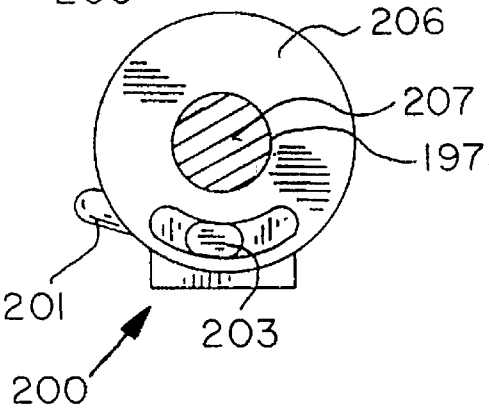
FIG. 44 is an end elevational view thereof showing the detent latch in the release position.
Figure 41:
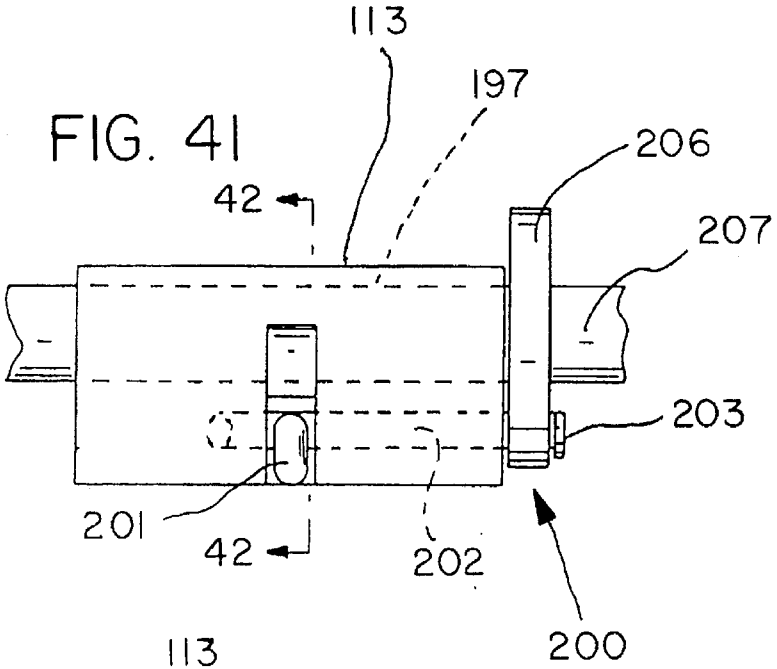
FIG. 41 is a side elevational view illustrating the shoulder retaining unit, release lever and detent latch. The spring tension housing has been broken away for ease of illustration.
Figure 42:
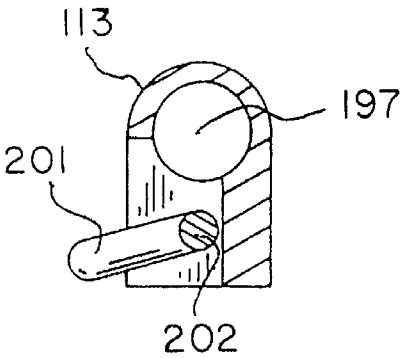
FIG. 42 is a cross-section view taken along lines 42—42 of FIG. 41, with the spring tension housing removed.

The protractor retainer 113 (FIGS. 40–45) besides providing for a passage 197 for the spring tension housing 198 also provides for a detent mechanism 200 embodying a lever 201 joined to a shaft 202 and detent latch 203. The raising and lowering of the lever 201, raises and lowers the detent latch 203. A keeper 205 on a collar 206 attached to the shaft of the spring tension housing shaft 207 is shaped to receive the detent latch 203 when the lever 201 is raised (FIG. 44) and is shaped to retain the detent latch 203 when the lever 201 is in the lowered position (FIG. 43). The keeper 205 is in an elongated shape to allow for lateral motion of the spring tension housing shaft 207 and thus allowing for lateral motion of the physical therapy strut assembly 112. The detent collar 206 can be permanently affixed to shaft 207 of the spring tension housing 198 or held in place by screws or like means.

Figure 40:
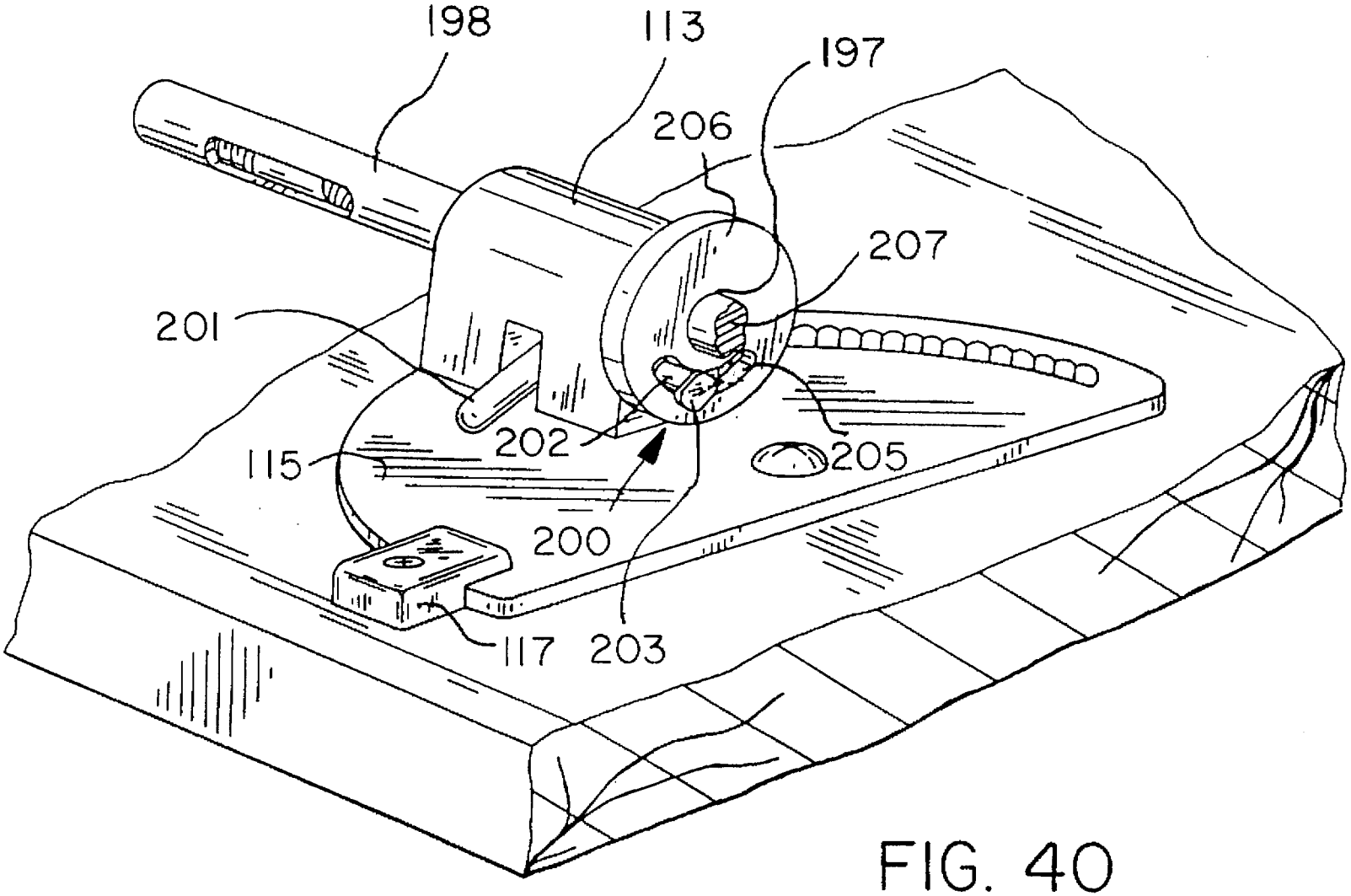
FIG. 40 is a perspective view illustrating the detent and shoulder retaining unit on the protractor, as well as the protractor guide. The spring tension housing has been broken away to more clearly show the detent latch in the keeper.
Figure 45:
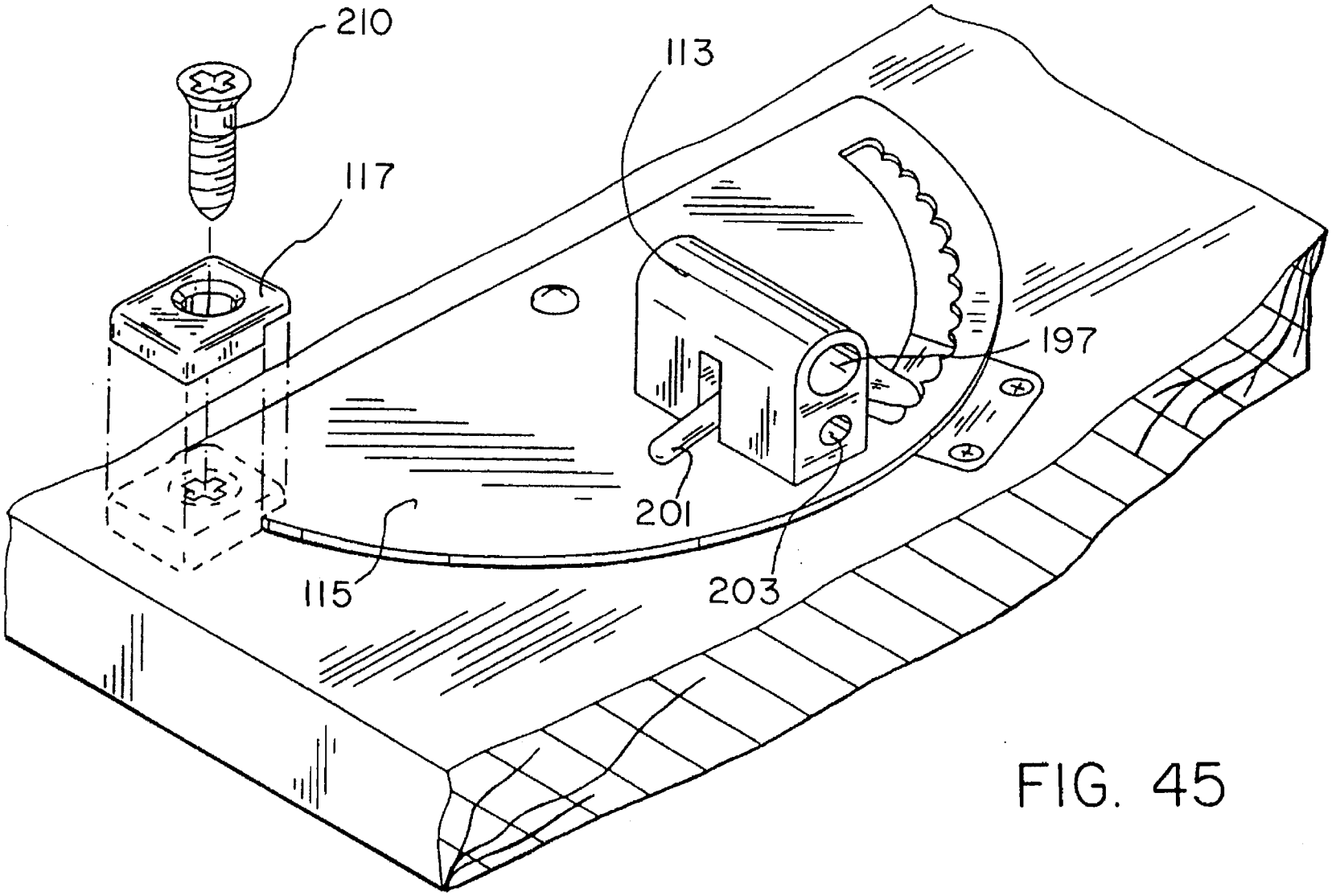
FIG. 45 is a view illustrating the retaining unit on the protractor with the protractor guide disassembled.

A protractor gauge 209, is held in place by a screw 210 shown in FIGS. 40 and 45. The gauge 209 arrangement stabilizes the protractor 115 and allows the protractor 115 to turn more freely.

In operating the Dynasplint shoulder device the therapist gently secures the patient to the shoulder device through the wrist stabilizer for consistent day-to-day usage. The therapist then makes a tension adjustment for shoulder external rotation at the elbow tensioning device. The abduction protractor is then set by merely setting the degree of abduction to the desired angle. The elevation component or the shoulder pivot tension is then set. This is a most important feature of the shoulder therapy device because of its ability to accommodate to the multi-axial, multi-planar biomechanics of the complex shoulder joint. This movement is achieved by the synchronized actions of the elevation, external rotation and telescoping components of the upper extremity linkage design.

Shoulder LPS™ System Protocol

The Shoulder System is designed to treat adhesive capsulitis/frozen shoulder. The System uses the principles of dynamic stressing, also referred to as low-load, prolonged-duration stretching. The goal is for a near complete resolution of the frozen shoulder, in the shortest period of time. Depending on many factors, including patient history, diagnosis, compliance levels, degree and severity of condition being treated, the total time required from onset of treatment to completion of the program, using the Dynasplint™ System can range from three weeks to three months.

The following protocol is recommended:

1. Carefully assess the patient's active and passive shoulder range of motion in all planes including flexion, external rotation, abduction, horizontal abduction and internal rotation. The patient needs a minimum of 70° of flexion, actively or passively, in order to begin treatment with the frozen shoulder physical therapy device or Shoulder System.
2. After the patient is properly fitted to the System, daily applications in-clinic can begin. Initially, 10 to 15-minute application periods (1 to 3 times per day) should be made. The elevation spring tension component is set to 3.0 and the external rotation spring tension component is set to 1.0.
3. Graduate the application periods up to 15 to 30-minute sessions (2 to 3 times per day) while keeping the tension settings unchanged. After one to two weeks of in-clinic use, the patient may begin daily applications at home as well. It also may be beneficial to use moist heat application during Dynasplint™ frozen shoulder physical therapy sessions. This can be achieved using hot packs or hot, moist towels. While in-clinic, other treatment interventions such as gentle joint mobilization, gentle passive range-of-motion exercises, ultrasound, electrical stimulation, etc., may be instituted.
4. After maximum application time is achieved, graduate the tension as tolerated by the patient in increments of 0.5 in both the elevation and external rotation components. Remember, just as with all other Dynasplint LPS™ Systems, never sacrifice time of application for higher levels of tension.

There are many benefits to be derived from using the frozen shoulder physical therapy device of this invention.

The device is unique in that it allows for the dynamic stressing of the shoulder. Greater benefit will be derived from this device as opposed to the passive motion devices in that the device provides added use of musculature, thereby bringing about a more speedy recovery. The device is envisioned as being a device primarily employed for treating frozen shoulder (Adhesive Capsulitis), however the device could be used to strengthen the musculature of the arm and shoulder as needed.

There are also many advantages to be derived from the preferred embodiment shoulder physical therapy device.

Among these advantages are the fact that there is a new reciprocating telescoping upper arm strut which will not twist or bend during use. The use of a special type of roller ball bearing sleeve will greatly reduce friction and facilitate reciprocating motion. Further, the construction of the reciprocating telescoping upper arm strut will resist twisting and binding during normal operation. Thus assuring a long life for the therapy device.

The forearm strut can be conveniently adjusted as to length by an easy-to-use detent.

The protractor guide will allow for the smooth angle adjustment of the protractor.

There is an easy-to-lock and easy-to-release detent arrangement for quick and easy removal of the physical therapy device subassembly from the protractor retainer on the left side of the base to the protractor retainer on the right side of the base and vice versa.

Obviously, many modifications may be made without departing from the basic spirit of the present invention. Accordingly, it will be appreciated by those skilled in the art that within the scope of the appended claims, the invention may be practiced other than has been specifically described herein.

We claim:

1. In an articulated should physical therapy device for improving the range of motion of a shoulder which allows for the active multiaxial physical therapy of a shoulder, said device being provided with a forearm strut which is attached by an elbow hinge to a first end of a reciprocating telescopic upper arm strut and with the second end of said reciprocating telescopic upper arm strut being attached to a shoulder hinge and being provided with means for accommodating the multiaxial rotation of the shoulder, the physical therapy device also being supplied with one or more tensioning means to place stress on the shoulder during active multiaxial physical therapy to thereby improve the mobility of the shoulder and hasten the return of the shoulder to normal mobility, the device comprising the improvement wherein said reciprocating telescopic upper arm strut is formed of converse sets of multiple rods and multiple scope plates, with the reciprocating telescopic upper arm strut allowing for the lengthening or shortening of the upper arm strut during active multiaxial physical therapy of the shoulder.

2. The articulated shoulder physical therapy device of claim 1 wherein the converse sets of multiple rods and multiple scope plates are enclosed in a cylindrical scope tube.

3. The articulated shoulder physical therapy device of claim 1 wherein the multiple scope plates have holes through which can pass the multiple rods during reciprocation.

4. The articulated shoulder physical therapy device of claim 1 wherein the tensioning means to place stress on the shoulder is positioned at an elbow hinge between the forearm strut and upper arm strut.

5. The articulated shoulder physical therapy device of claim 1 wherein the tensioning means to place stress on the shoulder is positioned at the shoulder hinge of the upper arm strut.

6. An articulated shoulder physical therapy device of claim 1 wherein there is a tensioning means at the shoulder hinge and a second tensioning means at the elbow hinge.

7. The articulated shoulder physical therapy device of claim 1 wherein the tensioning means is provided with a mechanism for quantifiably adjusting the amount of tension.

8. The articulated shoulder physical therapy device of claim 1 wherein the forearm strut is provided with a cam-operated means to adjust the length of the forearm strut.

9. The articulated shoulder physical therapy device of claim 1 wherein the forearm strut has attached thereto a means for securing the arm to the forearm strut.

10. The articulated shoulder physical therapy device of claim 1 wherein there is provided a base having mounted thereon a protractor and fixedly attached to the protractor a detent operated securing means for attaching said articulated shoulder physical therapy device to the base.

11. An articulated shoulder physical therapy device for releasing a frozen shoulder which allows for multiaxial physical therapy of the shoulder in the directions of flexion, extension, abduction, adduction, horizontal abduction, horizontal adduction, external rotation and internal rotation, the device comprising (a) a cam-operated adjustable forearm strut, (b) a reciprocating telescoping upper arm strut comprising converse sets of multiple rods and multiple scope plates, (c) an adjustable protractor with a detent retaining means attached thereon, and (d) a base, said adjustable forearm strut having a first end and a second end, the cam-operated adjustment means positioned therebetween such that the forearm strut can be adjusted to accommodate the length of the arm of the user, said first end of said forearm strut having attached thereto a means for retaining the forearm, said reciprocating telescoping upper arm strut having a first end and a second end, said first end of said reciprocating telescoping upper arm strut being attached to said second end of said adjustable forearm strut with an elbow hinge having a first tensioning means, said second end of the reciprocating telescoping upper arm strut being pivotally attached to said adjustable protractor with a shoulder hinge having a second tensioning means and said detent retaining means, said shoulder hinge and said adjustable protractor comprising means for accommodating the multiaxial rotation of the shoulder, said adjustable protractor being mounted on said base, such that when a patient is fitted into the physical therapy device with the tensioning means set, the patient can engage in multiaxial physical therapy for the shoulder.

12. The articulated shoulder physical therapy device of claim 11 wherein an spring produces the tension on the tensionally hinged and pivotally tensionally attached components of the physical therapy device.

13. The articulated shoulder physical therapy device of claim 11 wherein the tensioning means is provided with a mechanism for quantifiably adjusting the amount of tension applied to said elbow hinge or said shoulder hinge.

14. The articulated shoulder physical therapy device of claim 12 wherein the forearm strut is provided with a cam detent means to adjust the length of the forearm strut.

15. The articulated shoulder physical therapy device of claim 11 wherein the forearm strut has attached thereto a means for securing the arm to the forearm strut.

16. The articulated shoulder physical therapy device of claim 11 wherein the base has a left side and a right side and wherein both the left side and the right side of said base are provided with a protractor having securing means fixedly attached thereto for attaching said telescoping upper arm strut such that a single forearm and upper arm linkage can be removably attached to either protractor to thereby treat either the left shoulder or the right shoulder.

17. The articulated shoulder physical therapy device of claim wherein the forearm strut is joined to the upper arm strut by a serrated knuckle used to adjust the angle of articulation plane of the forearm strut.

18. An articulated shoulder physical therapy device for releasing a frozen shoulder which allows for multiaxial physical therapy of the frozen shoulder in the directions of flexion, extension, abduction, adduction, horizontal abduction, horizontal adduction, external rotation and internal rotation, the device comprising (a) an adjustable forearm strut, having means to retain the arm, (b) a reciprocating telescoping upper arm strut comprising converse sets of multiple rods and scope plates, (c) an adjustable protractor with attached retaining means, and (d) a base, said adjustable forearm strut having a first end and a second end and a cam-operated detent adjustment means positioned therebetween such that the forearm strut can be adjusted to accommodate the length of the arm of the user, said reciprocating telescoping upper arm strut having a first end and a second end, said first end of said reciprocating telescoping upper arm strut being attached to said second end of said adjustable forearm strut with an elbow hinge having a first tensioning means, said second end of the reciprocating telescoping upper arm strut being pivotally attached to said adjustable protractor with a shoulder hinge having a second tensioning means and said retaining means, said shoulder hinge and said adjustable protractor comprising means for accommodating the multiaxial rotation of the shoulder, said adjustable protractor being mounted on said base, such that when a patient is fitted into the physical therapy device with the tensioning means set, the patient can engage in multiaxial physical therapy for a frozen shoulder.

19. The articulated shoulder physical therapy device of claim 18 wherein the base has a left side and a right side and wherein both the left side and the right side of said base are provided with a protractor having securing means fixedly attached thereto for attaching said telescoping upper arm strut such that a single forearm and upper arm linkage can be removably attached to either protractor to thereby treat either the left shoulder or the right shoulder.

* * * * *